US008087437B2

(12) United States Patent
Goddard et al.

(10) Patent No.: US 8,087,437 B2
(45) **Date of Patent: *Jan. 3, 2012**

(54) ROUTER

(75) Inventors: Jay A. Goddard, Easley, SC (US); Randy McDonald, Sussex, WI (US); Dale Borchardt, Wind Lake, WI (US); Troy Thorson, Waukesha, WI (US); Jeffrey Hessenberger, Neosho, WI (US); Christopher Berg, Milwaukee, WI (US); Jeffrey Holly, West Bend, WI (US)

(73) Assignees: Techtronic Power Tools Technology Limited, Tortola (VG); Milwaukee Electric Tool Corporation, Brookfield, WI (US)

( * ) Notice: Subject to any disclaimer, the term of this patent is extended or adjusted under 35 U.S.C. 154(b) by 61 days.

This patent is subject to a terminal disclaimer.

(21) Appl. No.: 12/555,250

(22) Filed: Sep. 8, 2009
(Under 37 CFR 1.47)

(65) Prior Publication Data

US 2010/0126627 A1 May 27, 2010

Related U.S. Application Data

(60) Continuation-in-part of application No. 12/405,743, filed on Mar. 17, 2009, now Pat. No. 7,669,620, which is a continuation of application No. 10/831,738, filed on Apr. 23, 2004, now Pat. No. 7,523,772, which is a division of application No. 10/718,048, filed on Nov. 19, 2003, now Pat. No. 6,951,232, which is a continuation of application No. 09/927,448, filed on Aug. 11, 2001, now Pat. No. 6,725,892.

(60) Provisional application No. 60/224,852, filed on Aug. 11, 2000, provisional application No. 61/096,151, filed on Sep. 11, 2008.

(51) Int. Cl.
*B27C 5/10* (2006.01)

(52) U.S. Cl. ..... 144/136.95; 409/182

(58) Field of Classification Search ..... 144/136.95, 144/154.5; 409/182, 206, 210, 214, 218
See application file for complete search history.

(56) References Cited

U.S. PATENT DOCUMENTS 1,565,790 A 12/1925 Carter (Continued)

FOREIGN PATENT DOCUMENTS

CA 2314653 7/2000

OTHER PUBLICATIONS

Heavy Duty Variable Speed Laminate Trimmer, printed from web site www.rigid.com, available at least as early as Sep. 9, 2008, 1 page.

(Continued)

*Primary Examiner* — Shelley Self
(74) *Attorney, Agent, or Firm* — Michael Best & Friedrich LLP

(57) ABSTRACT

A router includes a base, a motor housing supported by the base for movement along a first axis, and an adjustment mechanism having a shaft, with a thread portion, connected to the motor housing for rotation about a second axis. The adjustment mechanism also includes a unitarily formed lock mechanism supported by the base. The lock mechanism includes a thread-engaging member that, when engaged with the thread portion, causes small changes to the position of the housing relative to the base in response to rotation of the shaft. The lock mechanism is movable between an engaged position, in which the thread-engaging member engages the thread portion, and a disengaged position, in which the thread-engaging member disengages the thread portion and the housing is freely movable relative to the base to provide course adjustment of the position of the housing relative to the base.

20 Claims, 20 Drawing Sheets

U.S. PATENT DOCUMENTS

| | | | |
|---|---|---|---|
| 1,611,381 | A | 12/1926 | Salsbury |
| 2,799,305 | A | 7/1957 | Groehn |
| 2,942,173 | A | 7/1958 | Turner et al. |
| 2,943,654 | A | 7/1960 | Emmons |
| 3,289,718 | A | 12/1966 | Willis |
| 3,363,510 | A | 1/1968 | Burrows et al. |
| 3,466,973 | A | 9/1969 | Rees |
| 3,481,453 | A | 12/1969 | Shreve, III et al. |
| 3,487,747 | A | 1/1970 | Burrows et al. |
| 3,489,191 | A | 1/1970 | Blevins |
| 3,494,395 | A | 2/1970 | Graham |
| 3,587,387 | A | 6/1971 | Burrows et al. |
| 3,767,876 | A | 10/1973 | Batson |
| 3,767,948 | A | 10/1973 | Batson |
| 4,108,225 | A | 8/1978 | Hestily |
| 4,239,428 | A | 12/1980 | Berzina |
| 4,319,860 | A | 3/1982 | Beares |
| 4,406,568 | A | 9/1983 | Rogers et al. |
| 4,440,050 | A | 4/1984 | Kagerer |
| 4,445,811 | A | 5/1984 | Sanders |
| 4,461,330 | A | 7/1984 | Judkins |
| 4,537,234 | A | 8/1985 | Onsrud |
| 4,562,872 | A | 1/1986 | Fushiya et al. |
| D286,132 | S | 10/1986 | Yamamoto |
| 4,652,191 | A | 3/1987 | Bernier |
| 4,674,548 | A | 6/1987 | Mills et al. |
| 4,770,573 | A | 9/1988 | Monobe |
| D300,501 | S | 4/1989 | Zurwelle |
| 4,938,264 | A | 7/1990 | Ferenczffy |
| 4,938,642 | A | 7/1990 | Imahashi et al. |
| 5,056,375 | A | 10/1991 | Kapton et al. |
| 5,074,724 | A | 12/1991 | McCracken |
| 5,078,557 | A | 1/1992 | McCracken |
| 5,088,865 | A | 2/1992 | Beth et al. |
| 5,117,879 | A | 6/1992 | Payne |
| 5,139,061 | A | 8/1992 | Neilson |
| 5,181,813 | A | 1/1993 | McCracken |
| 5,188,492 | A | 2/1993 | McCracken |
| 5,191,921 | A | 3/1993 | McCurry |
| 5,207,253 | A | 5/1993 | Hoshino et al. |
| D340,174 | S | 10/1993 | Hoshino et al. |
| 5,265,657 | A | 11/1993 | Matsumoto et al. |
| 5,273,089 | A | 12/1993 | Fuches et al. |
| 5,310,296 | A | 5/1994 | McCurry |
| D349,637 | S | 8/1994 | Hoshino et al. |
| 5,503,203 | A | 4/1996 | Stornetta |
| 5,590,988 | A | 1/1997 | Maurizio |
| 5,590,989 | A | 1/1997 | Mulvihill |
| 5,613,813 | A | 3/1997 | Winchester et al. |
| 5,662,440 | A | 9/1997 | Kikuchi et al. |
| 5,671,789 | A | 9/1997 | Stolzer et al. |
| 5,725,036 | A | 3/1998 | Walter |
| 5,813,805 | A | 9/1998 | Kopras |
| 5,853,273 | A | 12/1998 | Coffey |
| 5,853,274 | A | 12/1998 | Coffey et al. |
| 5,902,080 | A | 5/1999 | Kopras |
| 5,913,645 | A | 6/1999 | Coffey |
| 5,918,652 | A | 7/1999 | Tucker |
| D416,460 | S | 11/1999 | Bosten et al. |
| 5,988,241 | A | 11/1999 | Bosten |
| 5,997,225 | A | 12/1999 | Young et al. |
| 5,998,897 | A | 12/1999 | Bosten et al. |
| 6,065,912 | A | 5/2000 | Bosten et al. |
| 6,079,915 | A | 6/2000 | Bosten et al. |
| 6,113,323 | A | 9/2000 | Bosten et al. |
| 6,139,229 | A | 10/2000 | Bosten et al. |
| 6,182,723 | B1 | 2/2001 | Bosten et al. |
| 6,261,036 | B1 | 7/2001 | Bosten et al. |
| 6,318,936 | B1 | 11/2001 | McFarlin, Jr. et al. |
| 6,443,675 | B1 | 9/2002 | Kopras et al. |
| 6,443,876 | B1 | 9/2002 | Kopras |
| 6,488,455 | B1 | 12/2002 | Staebler et al. |
| D473,439 | S | 4/2003 | Grant et al. |
| 6,725,892 | B2 * | 4/2004 | McDonald et al. ..... 144/136.95 |
| 6,863,480 | B1 | 3/2005 | Taylor |
| 7,370,679 | B2 * | 5/2008 | McDonald et al. ..... 144/136.95 |
| 7,523,772 | B2 * | 4/2009 | McDonald et al. ..... 144/136.95 |
| 7,556,070 | B2 * | 7/2009 | McDonald et al. ..... 144/136.95 |
| 7,669,620 | B2 * | 3/2010 | McDonald et al. ..... 144/136.95 |
| 2002/0164223 | A1 | 11/2002 | Ryan et al. |
| 2006/0008334 | A1 | 1/2006 | Kageler et al. |

OTHER PUBLICATIONS

Thiel, David, Trim Routers, Popular Woodworking magazine, Jun. 2006, pp. 76-80.

Hull, Brent, Tool Test: Trim Routers, Journal Light Construction magazine, Jan. 2006, pp. 87-91.

* cited by examiner

ROUTER

RELATED APPLICATIONS

This application is a continuation-in-part of U.S. patent application Ser. No. 12/405,743 now U.S. Pat. No. 7,669,620 filed on Mar. 17, 2009, which is a continuation of U.S. patent application Ser. No. 10/831,738 filed on Apr. 23, 2004, now U.S. Pat. No. 7,523,772, which is a divisional of U.S. patent application Ser. No. 10/718,048 filed on Nov. 19, 2003, now U.S. Pat. No. 6,951,232, which is a continuation of U.S. patent application Ser. No. 09/927,448 filed on Aug. 11, 2001, now U.S. Pat. No. 6,725,892, which claims the benefit of expired U.S. Provisional Patent Application Ser. No. 60/224,852 filed on Aug. 11, 2000, the entire contents of all of which are incorporated herein by reference.

This application also claims priority to U.S. Provisional Patent Application Ser. No. 61/096,151 filed on Sep. 11, 2008, the entire content of which is incorporated herein by reference.

BACKGROUND OF THE INVENTION

The present invention relates to hand-held power tools and, more particularly to routers.

A router generally includes a base for supporting the router on a workpiece surface, a housing supported by the base and movable relative to the base, and a motor supported by the housing and operable to drive a tool element. In a fixed-base router, the housing is fixed or locked in a position relative to the base once the depth of cut of the tool element is set. In a plunge router, the housing is movable relative to the housing to the desired depth of cut so that the tool element "plunges" into the workpiece.

SUMMARY OF THE INVENTION

The invention provides, in one aspect, a router including a base for supporting the router on a work piece surface, a motor housing supported by the base for movement along a first axis to a position relative to the base, a motor supported by the housing and operable to drive a tool element, and an adjustment mechanism for adjusting the position of the housing relative to the base. The adjustment mechanism includes a shaft, having a thread portion, connected to the motor housing for rotation about a second axis. The adjustment mechanism also includes a unitarily formed lock mechanism supported by the base. The lock mechanism includes a thread-engaging member that is selectively engageable with the thread portion. When the thread-engaging member is engaged with the thread portion, rotation of the shaft causes small changes to the position of the housing relative to the base. The lock mechanism is movable between an engaged position, in which the thread-engaging member engages the thread portion, and a disengaged position, in which the thread-engaging member disengages the thread portion and the housing is freely movable relative to the base to provide course adjustment of the position of the housing relative to the base.

Other features and aspects of the invention will become apparent by consideration of the following detailed description and accompanying drawings.

BRIEF DESCRIPTION OF THE DRAWINGS

FIG. 12 is a cross-sectional view of the router of FIG. 1 taken along line 12-12 in FIG. 11.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
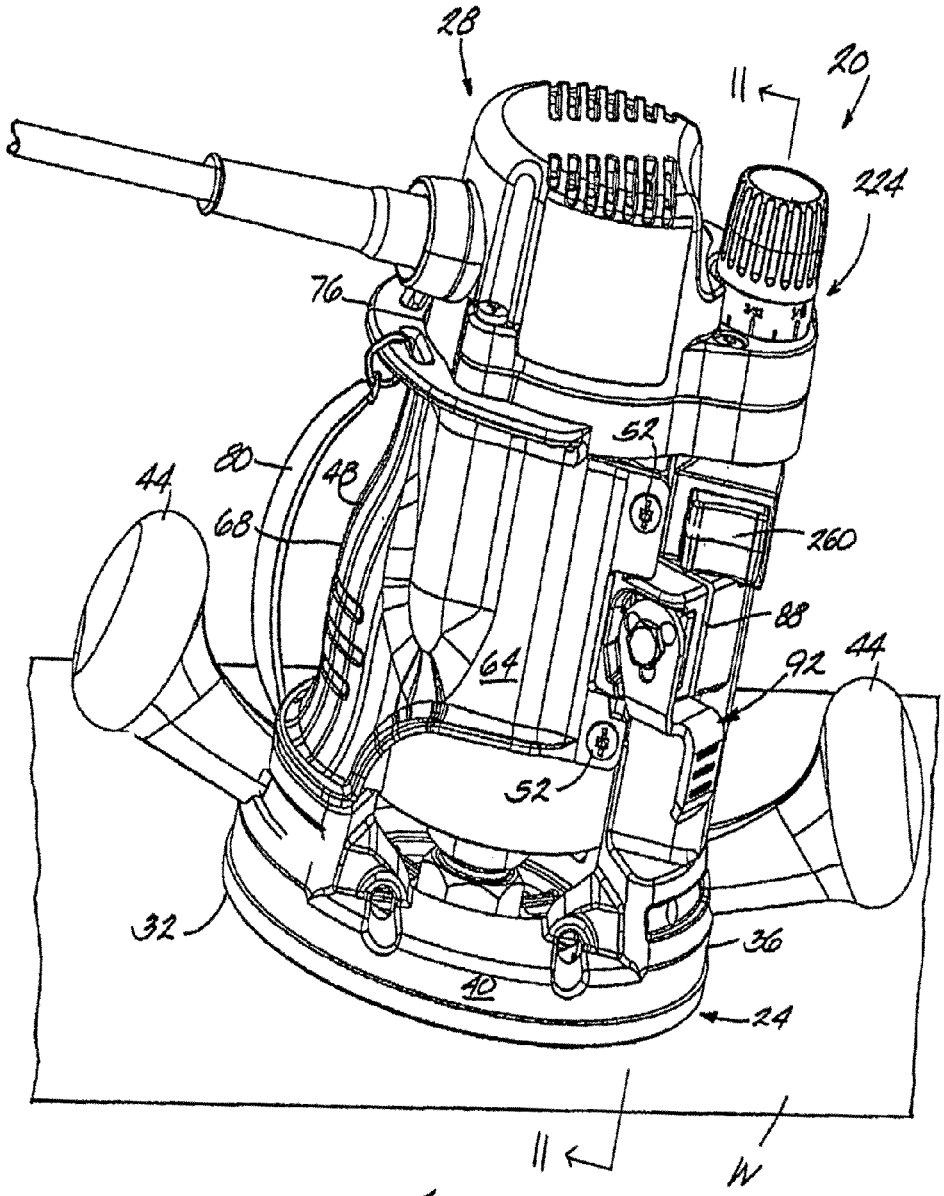
FIG. 1 is a perspective view of a router according to one embodiment of the invention.

FIG. 1 illustrates a hand-held router 20 according to one embodiment of the invention. The router 20 includes a base 24 and a motor housing 28 movably supported by the base 24. The housing 28 supports a motor 30 (FIG. 12) operable to drive a tool element (not shown) to cut a workpiece W. In the illustrated construction, the router 20 is a fixed-base router. Alternatively, the router 20 may be configured as a plunge router.

Figure 2:
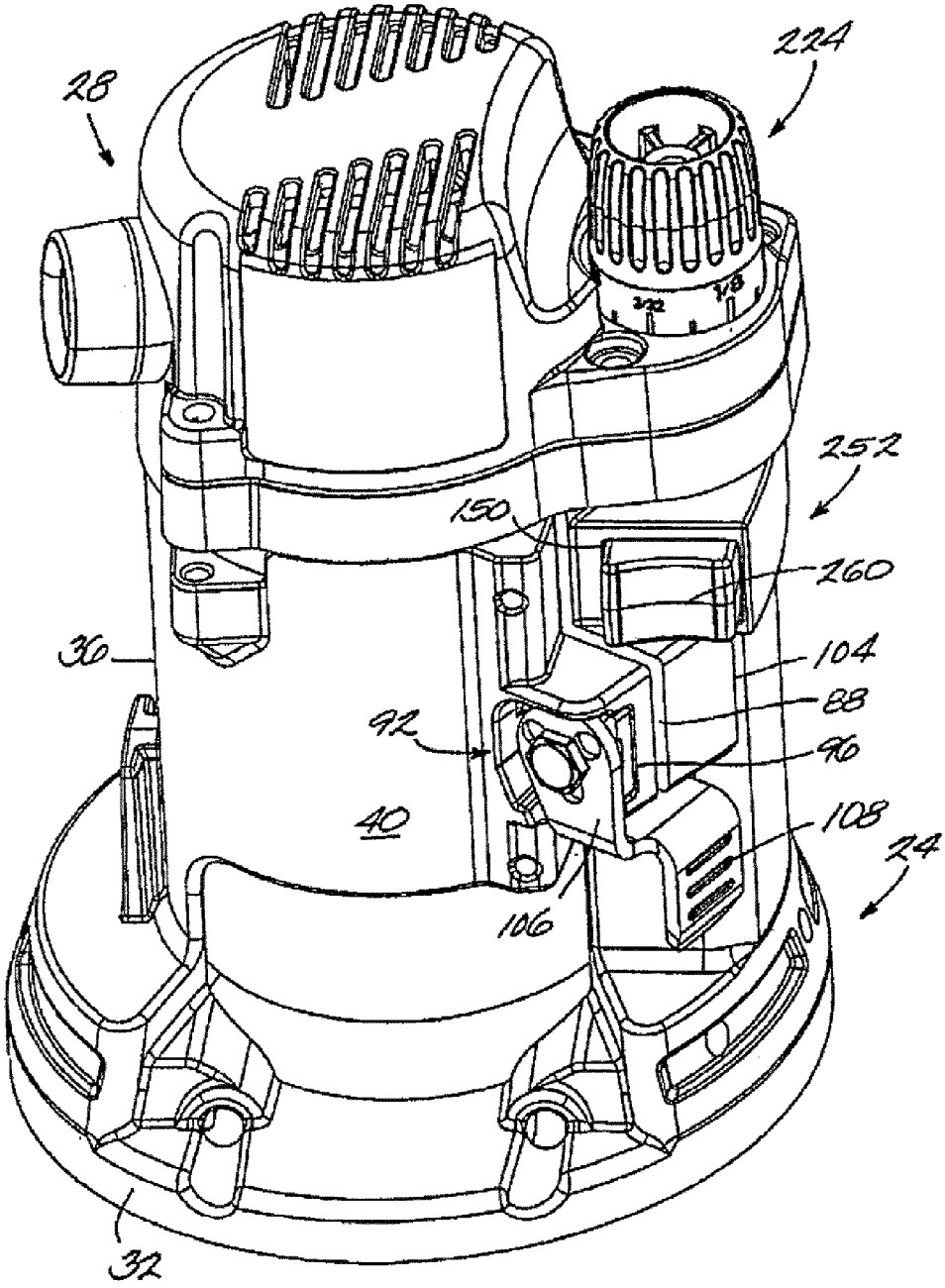
FIG. 2 is a perspective view of the router shown in FIG. 1 with portions removed.
Figure 3:
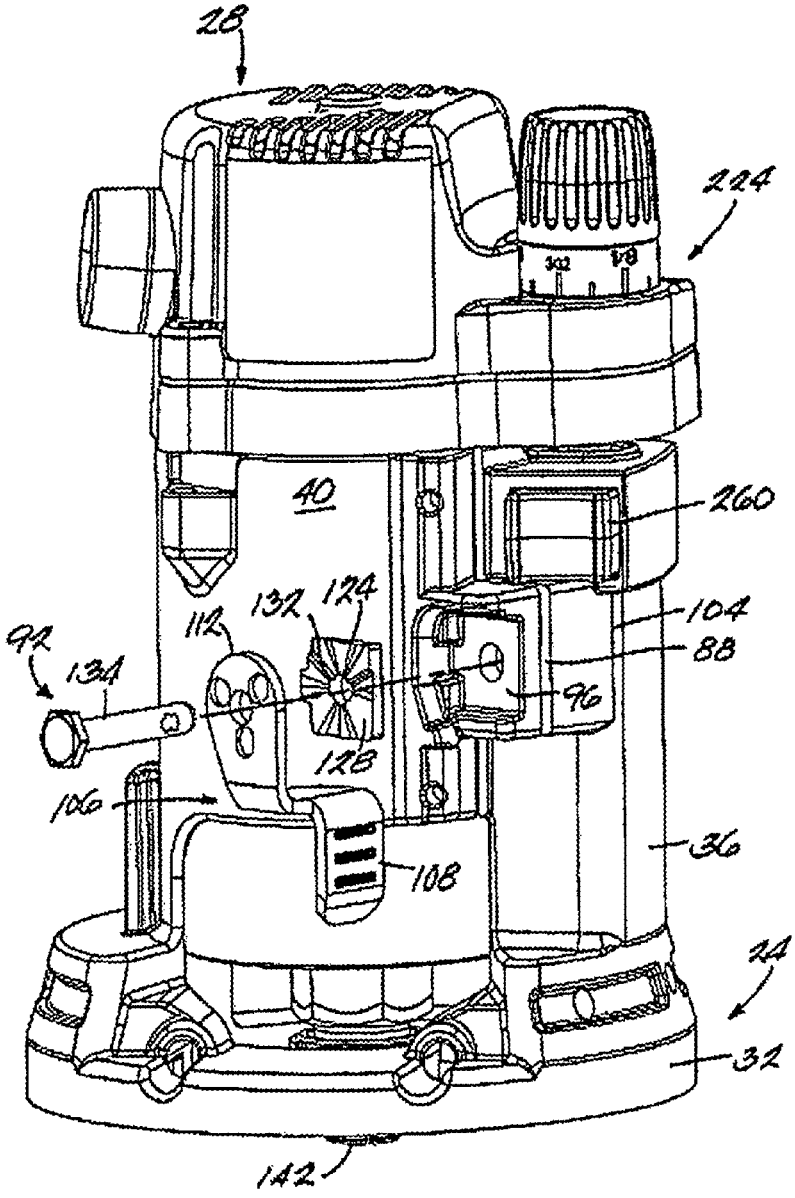
FIG. 3 is a perspective view of the router shown in FIG. 2 and illustrating an exploded view of a clamping mechanism.

As shown in FIGS. 1-3, the base 24 includes a sub-base or base plate 32 designed to interface with a work surface, such as a surface of the workpiece W. The base 24 also includes a generally cylindrical annular sleeve 36 extending upwardly from the base plate 32. The sleeve 36 is preferably fastened to, but may be formed integrally with the base plate 32 and has a generally cylindrical outer surface 40.

With reference to FIG. 1, the router 20 includes a pair of knob-like handles 44 that are removably mountable on the base 24 on opposite sides of the sleeve 36. The handles 44 may include soft-grip material covering at least a portion of the handle 44 to provide extra friction for gripping.

Figure 6:
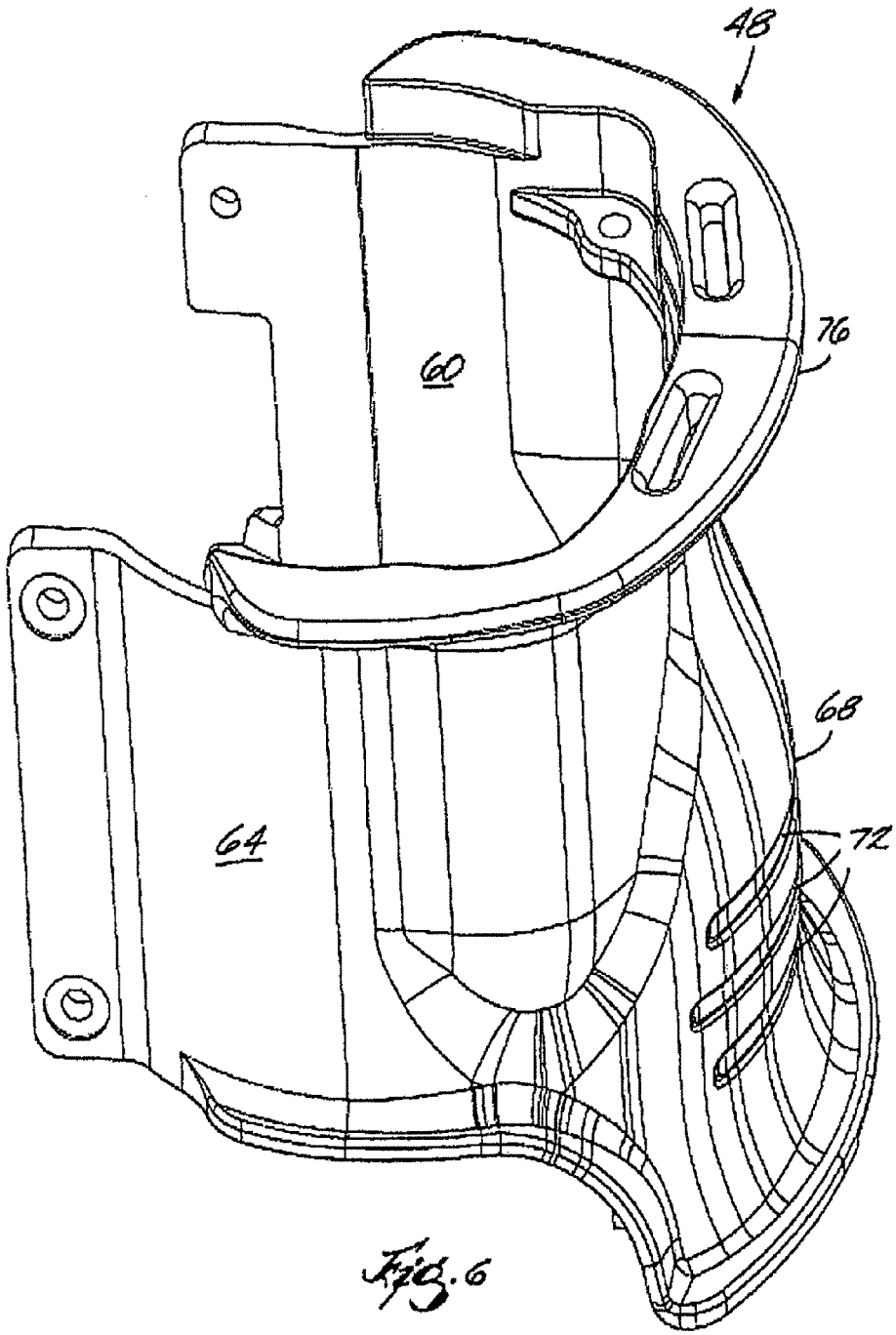
FIG. 6 is a perspective view of a hand grip of the router shown in FIG. 1.

As shown in FIGS. 1 and 6, the router 20 also includes a hand grip 48 attachable to the base 24 of the router 20. The hand grip 48 is attachable to the outer surface 40 of the sleeve 36 by fasteners 52 (FIG. 1). The hand grip 48 includes an inner surface 60 (FIG. 6) that is complementary to and engageable with the outer surface 40 of the sleeve 36, and an outer surface 64 that is generally arcuate in horizontal cross-section and surrounds a portion of the sleeve 36. The hand grip 48 subtends an angle around the outer surface of the base 24 of at least 180 degrees and, preferably, of at least 240 degrees or, more preferably, of at least 300 degrees.

The outer surface 64 of the hand grip 48 is preferably contoured to ergonomically match the shape of an operator's hand engaging the hand grip 48 and, thus, gripping the router 20. At least a portion of the hand grip 48 may include a soft grip 68 preferably formed of an elastomeric or tactile material to increase gripping friction. The soft grip 68 may also reduce the amount of vibration passed from the router 20 to an operator. The hand grip 48 may also include a plurality of ribs, ridges, or slots 72 to increase gripping friction.

With continued reference to FIG. 6, the hand grip 48 also includes a lip 76 extending radially outward from an upper edge of the hand grip 48. The lip 76 allows an operator to carry a portion of the weight of the router 20 on a side of the operator's hand (not shown) without relying solely on a pinch-type grip. The lip 76 may also prevent upward movement of the operator's hand off of the hand grip 48.

In other constructions, the hand grip 48 may have a different configuration. Also, the hand grip 48 may be replaced by another hand grip (not shown) having, for example, a different configuration and/or size or formed of a different material, as required by the operating parameters of the router 20 or by the preferences of an operator.

In other constructions (not shown), the hand grip 48 may be connected to the housing 28. For example, the hand grip 48 may be connected to an upper portion of the housing 28 and having a portion telescoping over the base 24. In another construction (not shown), the base 24 may be relatively short so that a majority of the housing 28 would be engageable by the operator without interference by the base 24. A separate support arrangement may provide support between the base 24 and the housing 28 without interfering with the hand grip 48 connected to the housing 28. Such constructions may be provided for a plunge-type router.

With reference to FIG. 1, the router 20 includes a hand strap 80 to assist an operator in gripping and controlling the router 20. The hand strap 80 passes over the back of the operator's hand and, in the illustrated construction, is made of a hook and loop fastener to allow an operator to adjust the fit of the hand strap 80. The hand strap 80 is attached to the base 24 on one end and to the lip 76 of the hand grip 48 on the other end. In other constructions (not shown), the hand strap 80 may be connected to the router 20 at other suitable points. Alternatively, the hand strap 80 may be omitted.

The sleeve 36 of the base 24 also has an inner surface 84 (FIG. 12) which may be slightly tapered outward in an upward direction. The sleeve 36 is somewhat resilient and is open on one side at a vertical seam 88 (FIGS. 2 and 3). As a result, the inner diameter of the sleeve 36 may be increased or decreased by opening or closing, respectively, the seam 88. The resilience of the sleeve 36 results in the seam 88 being partially open when no force is applied to close the seam 88.

As shown in FIGS. 2 and 3, the router 20 is configured as a fixed-base router and includes a clamping mechanism 92 to control the opening and closing of the seam 88. When the seam 88 is generally closed, the base 24 is in a clamped position, in which the position of the housing 28 relative to the base 24 is fixed. When the seam 88 is open, the base 24 is in a released position, in which the housing 28 is movable relative to the base 24. The clamping mechanism 92 includes a clamp pocket or receptacle 96 (FIG. 3) formed on the sleeve 36 on one side of the seam 88. The clamp receptacle 96 has an aperture therethrough. The clamping mechanism 92 also includes a clamp-receiving block 104 formed on the sleeve 36 on the other side of the seam 88. The clamp-receiving block 104 includes a blind recess therein (not shown).

Figure 4:
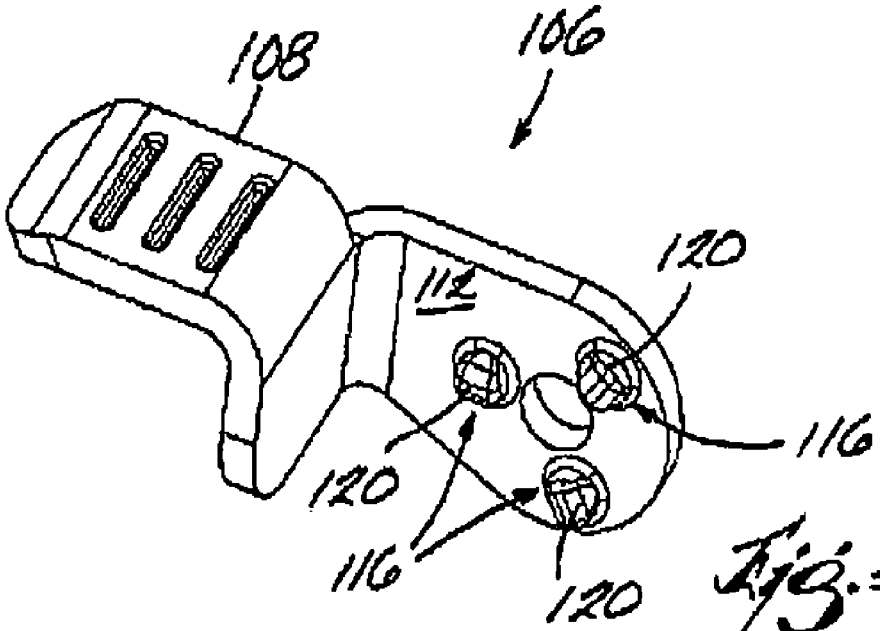
FIG. 4 is a enlarged perspective view of an actuator of the clamping mechanism shown in FIG. 3.
Figure 5:
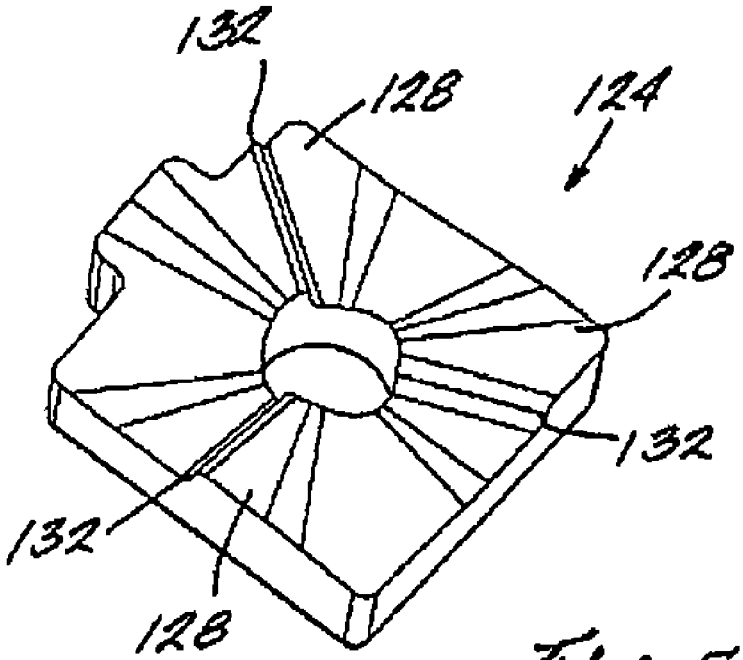
FIG. 5 is a enlarged perspective view of a cam block of the clamping mechanism shown in FIG. 3.

As shown in FIGS. 3 and 4, the clamping mechanism 92 also includes an actuator or clamp handle 106 including a gripping portion 108 and a cam portion 112. A plurality of cam members 116 (FIG. 4) are affixed to or formed on the inner face of the cam portion 112, and each cam member 116 has a cam surface 120. As shown in FIGS. 3 and 5, the clamping mechanism 92 also includes a generally square cam block 124 received in the clamp receptacle 96. A plurality of cam members 128 having cam surfaces 132 are formed on the outer surface of the cam block 124.

As shown in FIGS. 1-3, a clamping pin 134 connects the components of the clamping mechanism 92. The pin 134 extends through the cam portion 112 of the clamp handle 106, through the cam block 124, through the clamp receptacle 96, and into a recess (not shown) in the clamp-receiving block 104. The pin 134 is anchored within the recess in the clamp-receiving block 104.

The clamp handle 106 can rotate about the pin 134, but the cam block 124 is restricted from rotation by the clamp receptacle 96. As the clamp handle 106 is rotated about the pin 134, the cam surfaces 120 of the cam members 116 interact with the cam surfaces 132 of the cam members 128.

When the seam 88 is open, the clamp handle 106 is in a generally horizontal orientation, and the cam members 116 of the clamp handle 106 are radially displaced from the cam members 128 of the cam block 124. In such a position, the cam members 116 generally alternate with the cam members 128 allowing the seam 88 to be open. When the seam 88 is open, the clamping force applied by the base 24 to the housing 28 is reduced so that the housing 28 is movable relative to the base 24.

To close the seam 88, the clamp handle 106 is rotated into a generally vertical position (FIGS. 1 and 2). As the handle 106 is rotated, the cam surfaces 120 interact with the cam surfaces 132, forcing the cam members 116 and the cam members 128 into radial alignment, increasing the distance between the clamp handle 106 and the cam block 124. Because the pin 134 is anchored in the clamp-receiving block 104, this increase in distance is taken up by the seam 88, forcing the clamp receptacle 96 closer to the clamp-receiving block 104 and closing the seam 88. When the seam 88 is closed, the clamping force is increased to fix the housing 28 in a position relative to the base 24.

As shown in FIGS. 2 and 12, the housing 28 is generally vertically oriented and has a generally cylindrical outer surface. The housing 28 supports the motor 30 and associated components. The motor 30 includes a shaft 138, and a tool holder (e.g., a collet 142) is connected to or formed with the shaft 138. The tool element is supported by the collet 142.

The housing 28 is arranged to fit within the sleeve 36 and to be vertically movable relative to the sleeve 36. Closing the seam 88 using the clamping mechanism 92, as described above, causes the inner surface 84 of the sleeve 36 to engage the outer surface of the housing 28 to restrict the vertical movement of the housing 28. Opening the seam 88 releases the housing 28 and allows the housing 28 to be moved vertically.

Figure 7:
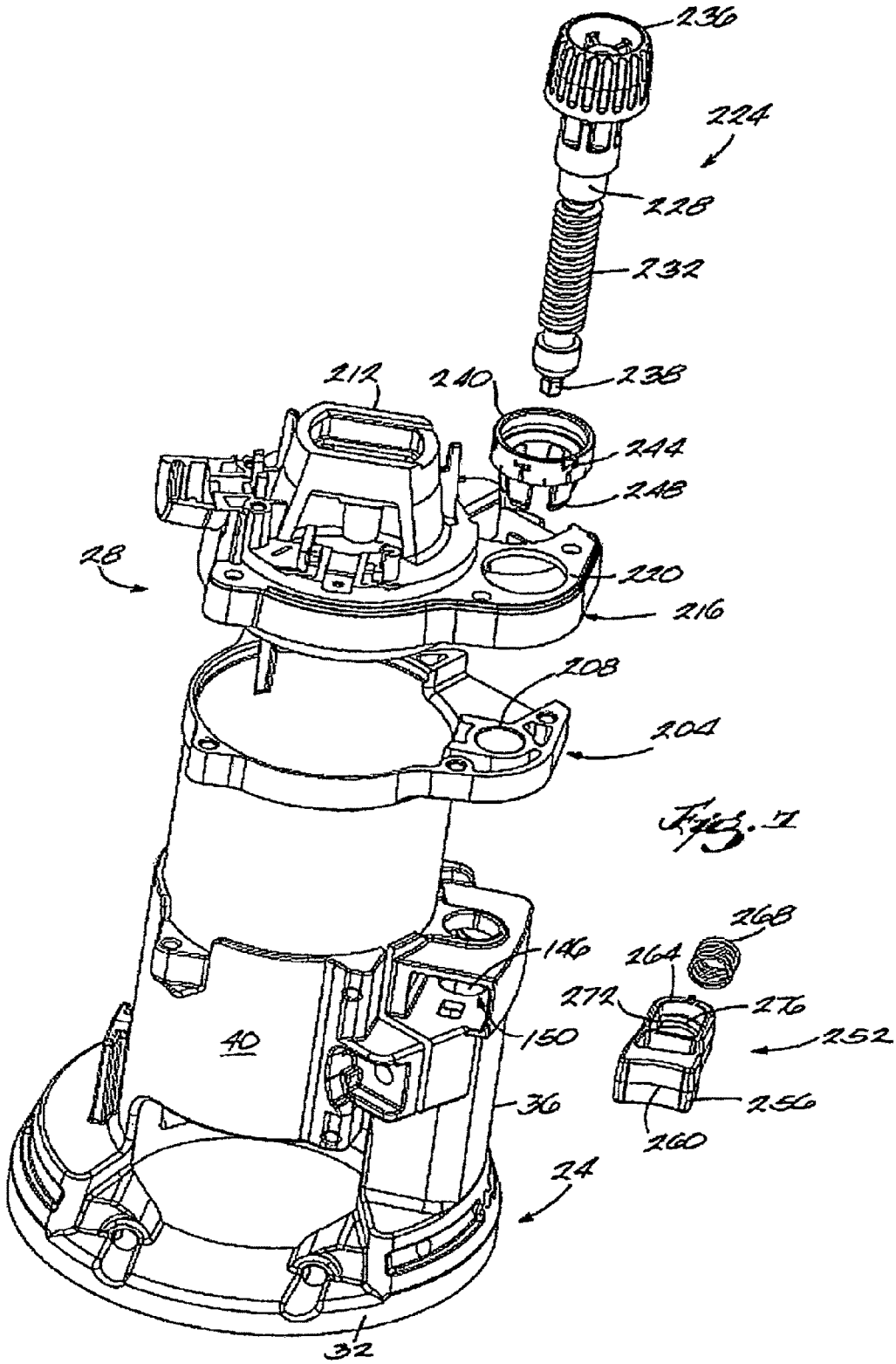
FIG. 7 is an exploded perspective view of the router shown in FIG. 1, illustrating a depth adjustment mechanism.
Figure 11:
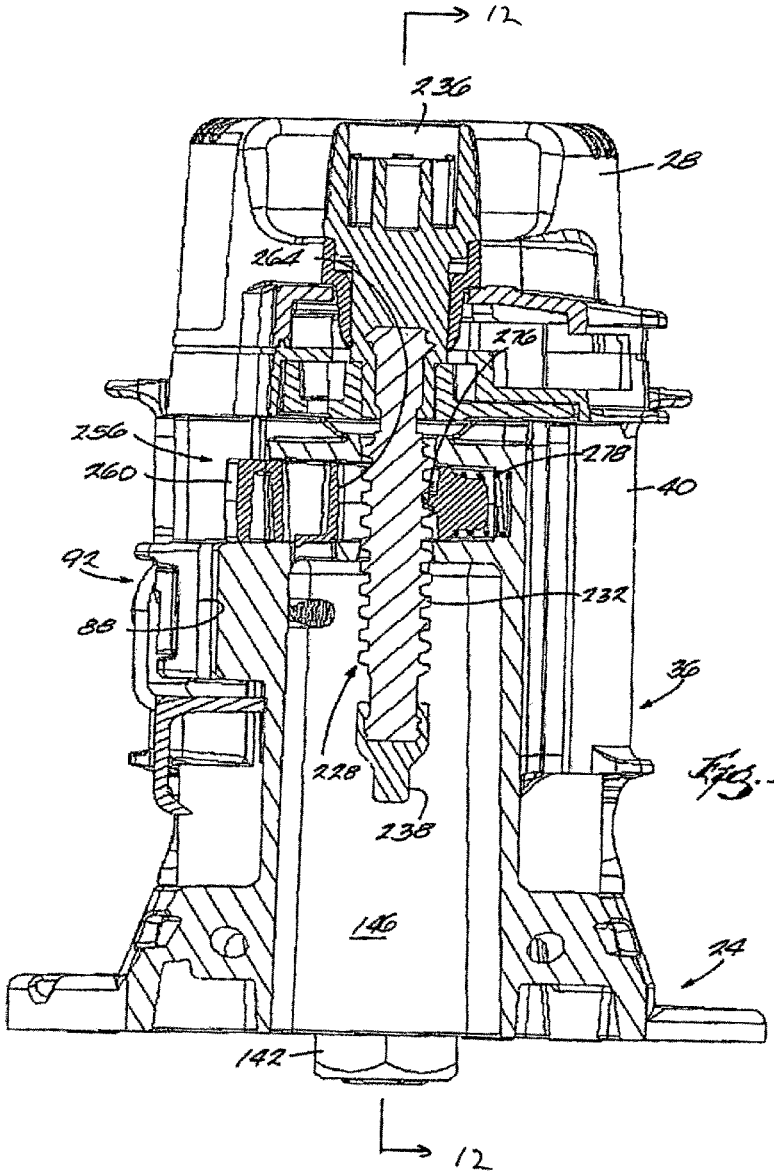
FIG. 11 is a cross-sectional view of the router of FIG. 1 taken along line 11-11 in FIG. 1.

As shown in FIGS. 7, 11, and 12, the base 24 defines a depth adjustment column 146 adjacent the clamp-receiving block 104 and is preferably formed integrally with the sleeve 36. The depth adjustment column 146 is generally hollow and has an open top end (FIG. 7).

As shown in FIGS. 7 and 11, the base 24 also defines a lock mechanism receptacle 150 in the sleeve 36 above the depth adjustment column 146. The lock mechanism receptacle 150 includes an open end and an aperture, and the aperture is vertically aligned with the open top end of the depth adjustment column 146.

As shown in FIGS. 7 and 12, the housing 28 includes a first depth adjustment interface 204 at the upper end of the housing 28. The first depth adjustment interface 204 includes a vertically-oriented aperture 208 therethrough which is vertically aligned with the aperture in the lock mechanism receptacle 150 and the opening 120 in the depth adjustment column 146.

The housing 28 also includes a housing cover 212 having a second depth adjustment interface 216. The second depth adjustment interface 216 includes a vertically-oriented aperture 220 therethrough which is vertically aligned with the aperture 208 in the first depth adjustment interface 204, the aperture 136 in the lock mechanism receptacle 150, and the open end of the depth adjustment column 146.

With reference to FIG. 7, the router 20 also includes a depth adjustment mechanism 224 which cooperates with the housing 28 and the base 24 to control the vertical position of the housing 28 relative to the base 24 and to thereby control the depth of cut of the tool element.

Figure 10:
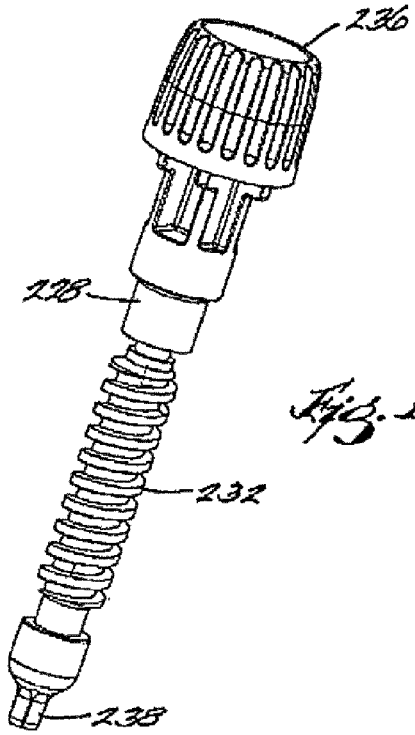
FIG. 10 is a perspective view of a depth adjustment shaft and dial of the depth adjustment mechanism shown in FIG. 7.

As shown in FIGS. 7, 10 and 12, the depth adjustment mechanism 224 includes a depth adjustment shaft 228, that is generally vertically oriented, having a threaded portion 232 generally housed within the depth adjustment column 146 and the lock mechanism receptacle 150. An adjustment knob 236 is attached to an upper end of the depth adjustment shaft 228. A lower end 238 has a non-circular cross-section and is engageable with an adjustment member (not shown) inserted through the base 24 and into the depth adjustment column 146 when the router 20 is utilized for an under-table cutting operation. The depth adjustment shaft 228 is vertically fixed, but rotatable relative to the housing 28 and moves vertically with the housing 28 relative to the base 24.

With reference to FIG. 7, the router 20 includes a position indication ring 240, imprinted or otherwise marked with position-indicating markings 244, attached to the second depth adjustment interface 216 by a plurality of resilient fingers 248 integrally formed with the position indication ring 240 so that the position indication ring 240 is fixed with but rotatable relative to the housing 28. The position indication ring 240 surrounds the depth adjustment shaft 228 and is positioned below the adjustment knob 236.

In other constructions (not shown), the position indication ring 240 may be attached to the housing 28 by other suitable structure. For example, the position indication ring 240 may be connected to but rotatable relative to the depth adjustment shaft 228.

As shown in FIGS. 2 and 7-9, the depth adjustment mechanism 224 also includes a lock mechanism 252 enclosed partially within the lock mechanism receptacle 150. The lock mechanism 252 is vertically fixed to the base 24 and is movable in a direction perpendicular to the axis of the depth adjustment column 146. The lock mechanism 252 includes a lock frame 256 having a lock button 260, engageable by the operator to move the lock frame 256, and defining a lock frame aperture 264, through which the threaded portion 232 of the depth adjustment shaft 228 passes.

Figure 8:
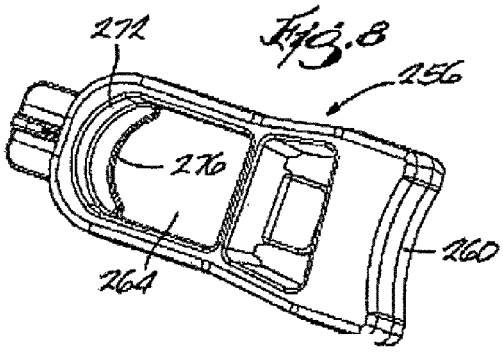
FIG. 8 is a perspective view of a lock frame of the depth adjustment mechanism shown in FIG. 7.
Figure 9:
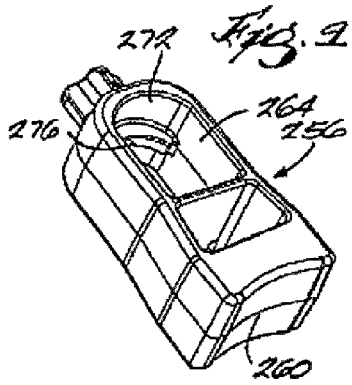
FIG. 9 is another perspective view of the lock frame of the depth adjustment mechanism shown in FIG. 7.

The lock frame aperture 264 includes an inner surface 272 and at least one locking projection or thread-engaging lug 276 formed on the inner surface 272 (FIGS. 8 and 9). The lug 276 is selectively engageable with the threaded portion 232. The lock frame 256 is movable between a thread-engaging position, in which the lug 276 engages the threaded portion 232, and a disengaged position, in which the lug 276 does not engage the threaded portion. The lock frame 256 is biased outwardly to the thread-engaging position by a spring or other biasing member 278 (FIG. 7).

The depth adjustment mechanism 224 may be used to adjust the vertical position of the housing 28 relative to the base 24 in two modes. For coarse adjustment, the lock button 260 is pushed inward against the biasing member 278, releasing the threaded portion 232 from engagement with the locking projection 276. The depth adjustment shaft 228 and the housing 28 are then free to translate or move in a vertical direction relative to the lock frame 256 and the base 24. Once the desired vertical position of the depth adjustment shaft 228 and the housing 28 is achieved, the lock button 260 is released and the biasing member 278 again biases the lock frame 256 outward to the thread-engaging position, causing the locking projection 276 to engage the threaded portion 232. Once the locking projection 276 is re-engaged with the depth adjustment shaft 228, the depth adjustment shaft 228 and the housing 28 are restricted from free translational movement.

For fine adjustment, the lock mechanism 252 remains engaged with the depth adjustment shaft 228. The adjustment knob 236 is rotated, thus rotating the depth adjustment shaft 228 and the threaded portion 232. The threaded portion 232 rotates relative to the locking projection 276 so that the depth adjustment shaft 228 and the housing 28 move in relatively small increments in a vertical direction relative to the lock frame 256 and the base 24.

In operation, an operator often needs to adjust the depth of cut of the router 20. To adjust the router 20 from a first depth of cut to second depth of cut, the operator first releases the clamping mechanism 92, as described above. This action opens the seam 88, releases the sleeve 36 from clamping engagement with the housing 28, and allows the housing 28 to be vertically moved relative to the base 24. Coarse adjustment of the position of the housing 28 relative to the base 24 is preferably performed first as described above. Fine adjustment of the position is then performed. Once the desired vertical position is achieved, the operator clamps the clamping mechanism 92, thus clamping the sleeve 36 to the housing 28 and substantially restricting the housing 28 from further movement relative to the base 24. The operator then operates the router 20 by grasping either the two knob-like handles 44 or the hand grip 48, as desired. Additional depth adjustments may be made by repeating this process.

Figure 13:
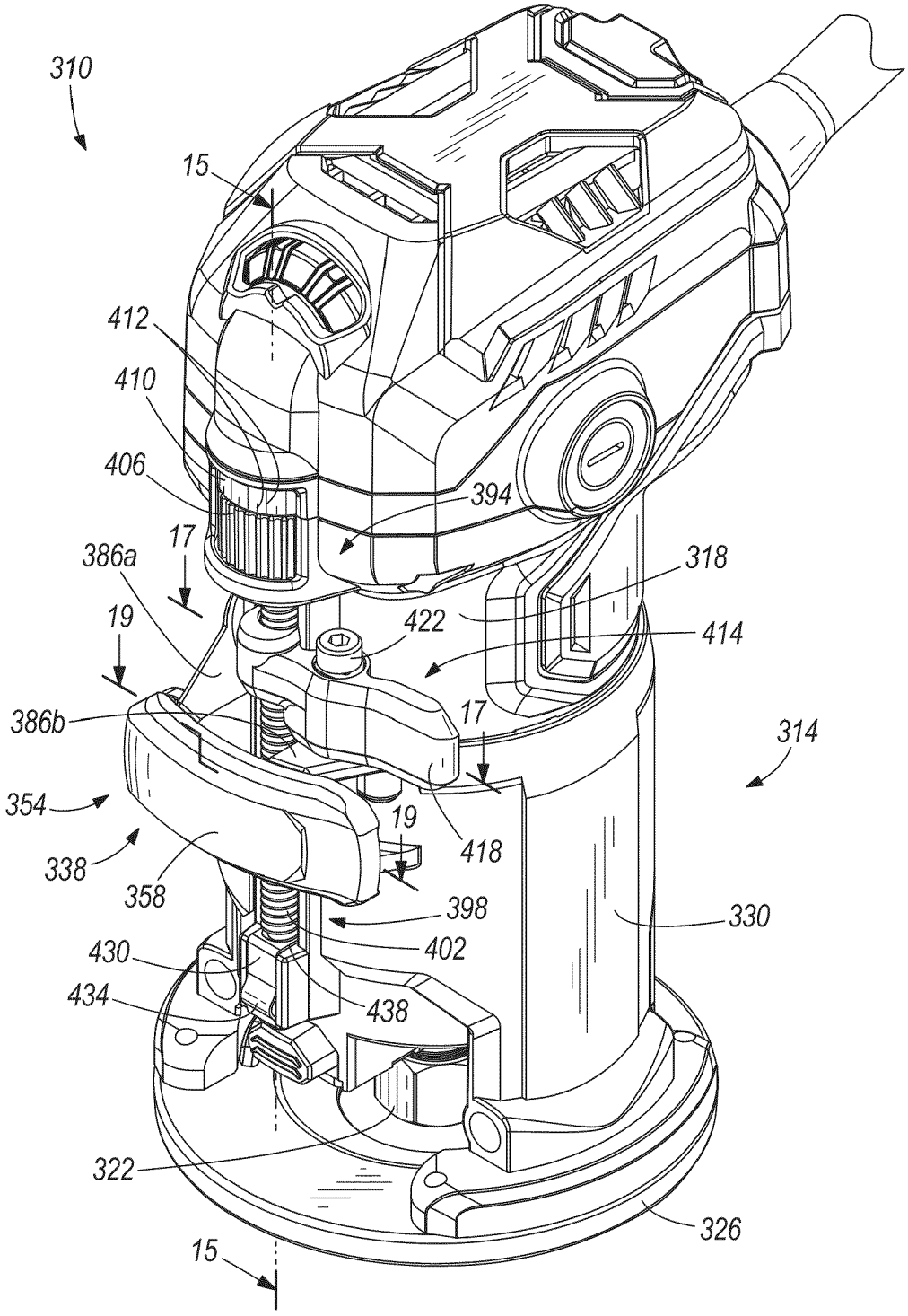
FIG. 13 is a front perspective view according to another embodiment of the invention.

FIG. 13 illustrates a hand-held router 310, for example, a laminate trimmer, according to another embodiment of the invention. The router 310 includes a base 314 and a motor housing 318 supported by the base 314. The housing 318 supports a motor 323 (FIG. 14) operable to drive a tool element (not shown) to cut a workpiece. The motor 323 includes a shaft 324 and a tool holder (e.g., a collet 322) connected to or formed with the shaft 324. The tool element is secured to the router 310 by the collet 322. In the illustrated construction, the router 310 is configured as a fixed-base router 310, however, the router 310 may alternatively be configured as a plunge router.

Figure 14:
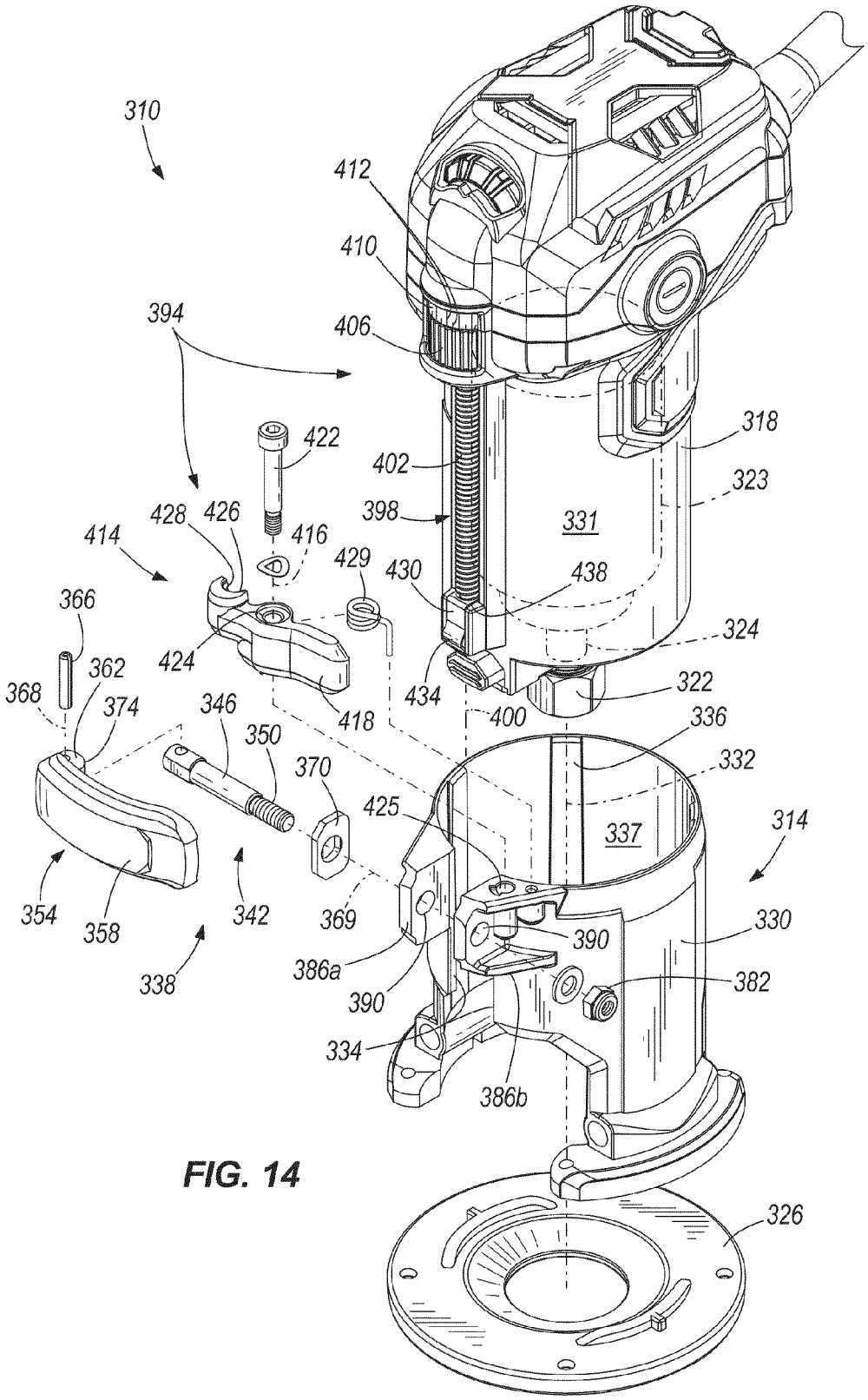
FIG. 14 is an exploded, front perspective view of the router of FIG. 13, illustrating a clamping mechanism and a depth adjustment mechanism.

With reference to FIGS. 13 and 14, the base 314 includes a base plate 326 configured to interface with a surface of the workpiece. The base 314 also includes a generally cylindrical sleeve 330 extending upwardly from the base plate 326. The sleeve 330 is coupled to the base plate 326 using fasteners (e.g., screws, bolts, etc.). Alternatively, the sleeve 330 may be integrally formed with the base plate 326 as a single piece. The housing 318 is generally vertically oriented and has a generally cylindrical outer surface 331. The housing 318 is arranged to fit within the sleeve 330 and to be vertically movable relative to the sleeve 330 along a central axis 332.

With reference to FIG. 14, the sleeve 330 is resilient and is open on one side at a vertical seam 334. As a result, the inner diameter of the sleeve 330 may be increased or decreased by opening or closing the seam 334, respectively. As used herein, "opening" the seam 334 includes increasing the spacing between the respective vertical edges of the sleeve 330 that define the seam 334, while "closing" the seam 334 includes decreasing the spacing between the respective vertical edges of the sleeve 330 that define the seam 334. The resilience of the sleeve 330 results in the seam 334 being partially open when no external force is applied to close the seam 334. In the illustrated construction of the router 310, the sleeve 330 includes a plurality of radially inwardly-extending ribs 336 on an inner surface 337 of the sleeve 330 that facilitate gripping the outer surface 331 of the motor housing 318.

With reference to FIGS. 13 and 14, the router 310 includes a fixing assembly or clamping mechanism 338 to control the opening and closing of the seam 334. When the seam 334 is generally closed, or the respective vertical edges of the sleeve 330 that define the seam 334 are closely spaced, the base 314 is in a clamped position (FIG. 19), in which the position of the housing 318 relative to the base 314 is fixed. When the seam 334 is open, or the respective vertical edges of the sleeve 330 that define the seam 334 are spaced further apart, the base 314 is in a released position (FIG. 20), in which the housing 318 is movable relative to the base 314. With reference to FIG. 14, the clamping mechanism 338 includes a clamp member 342 configured as a pin 346 having a threaded end 350, and an actuator 354 pivotably coupled to the pin 346 at the end opposite the threaded end 350. The actuator 354 includes a handle portion 358 and two spaced, substantially identical cam members 362 extending substantially perpendicularly from the handle portion 358. An axle 366 pivotably interconnects the cam members 362 and the pin 346, such that the actuator 354 is pivotable about a pivot axis 368 oriented perpendicularly to a longitudinal axis 369 of the pin 346.

Figure 19:
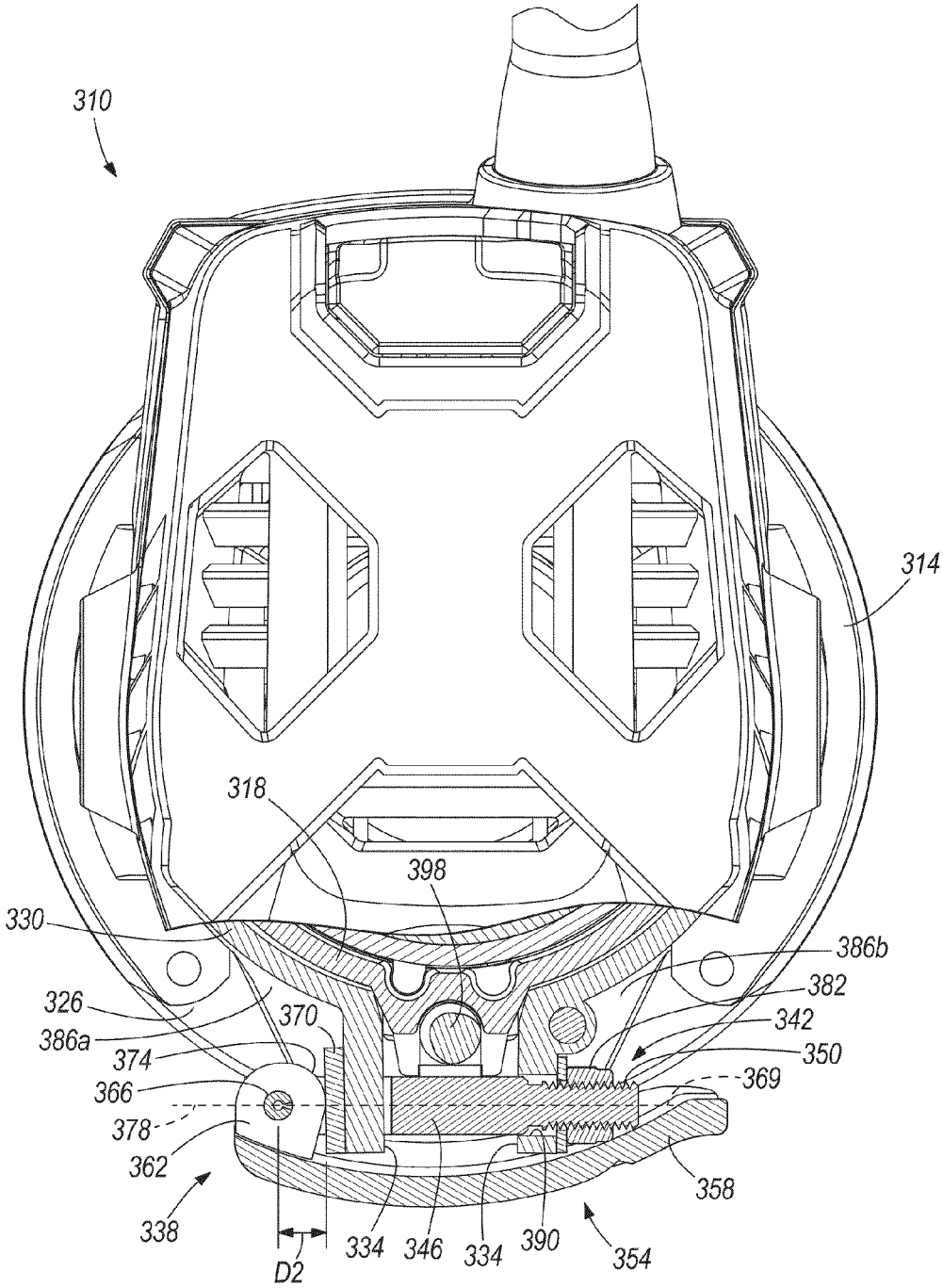
FIG. 19 is a cross-sectional view of the router of FIG. 13 taken along line 19-19 in FIG. 13, illustrating the clamping mechanism in a clamping position.
Figure 20:
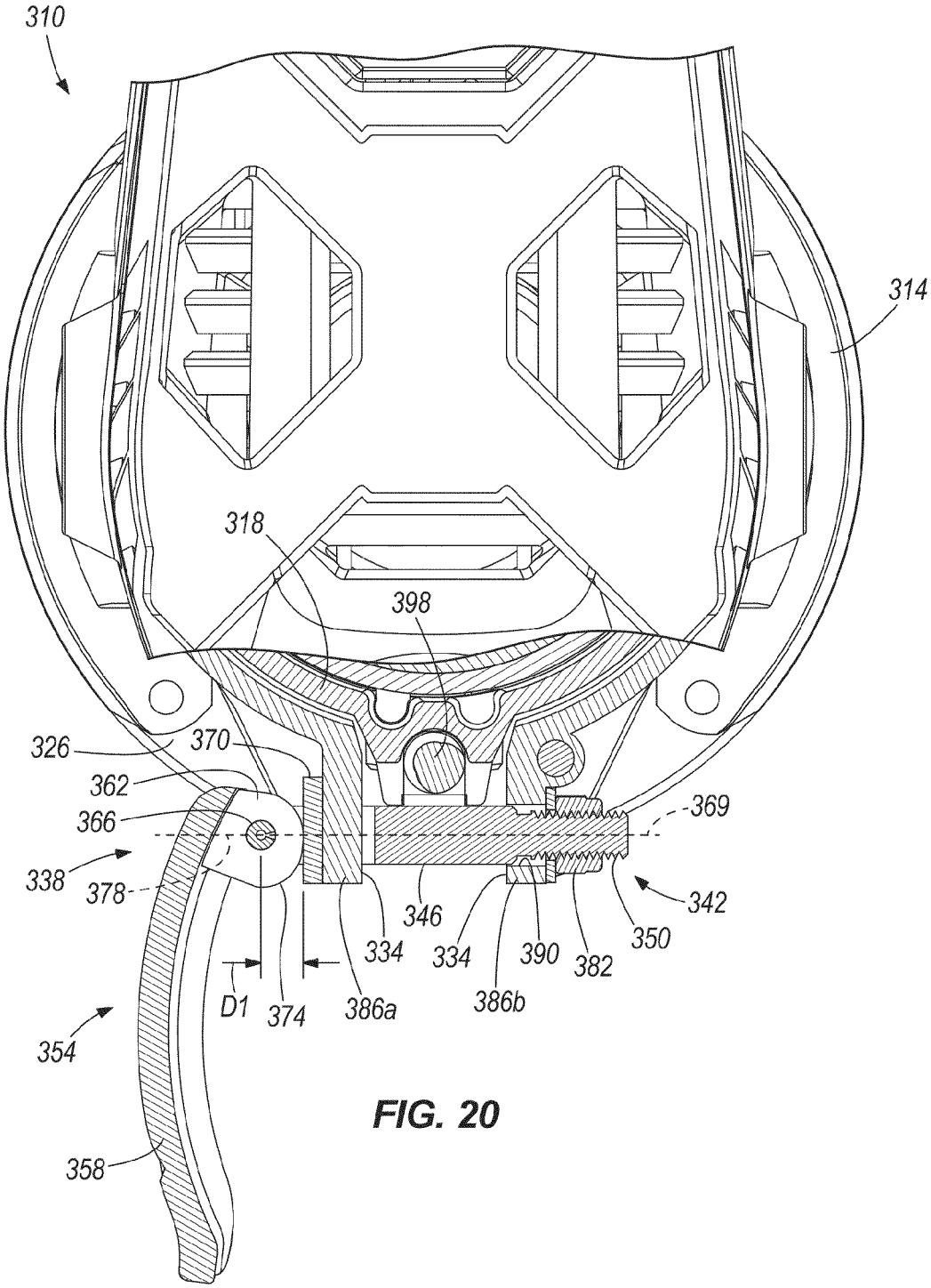
FIG. 20 is a cross-sectional view of the router of FIG. 19, illustrating the clamping mechanism in a release position.

The clamping mechanism 338 also includes a generally flat washer 370 slidably positioned on the pin 346. As shown in FIGS. 19 and 20, respective cam surfaces 374 of the cam members 362 slidably engage the washer 370. The "lift" of the cam members 362, defined by a varying distance between the axle 366 (i.e., intersecting the pivot axis 368) and the washer 370, along a line of contact 378 passing through the center of the axle 366 and the point of tangency between each of the cam surfaces 374 and the washer 370, imparts movement to the washer 370 when the actuator 354 is pivoted about the pivot axis 368. As shown in FIG. 14, a fastener 382 (e.g., a lock nut) is threaded to the threaded end 350 of the pin 346, such that a clamping load can be developed between the washer 370 and the fastener 382 when the washer 370 is moved away from the axle 366 by the sliding contact with the cam surfaces 374, due to pivoting of the actuator 354. Alternatively, the washer 370 may be omitted, and the cam members 374 may directly engage the housing 318 to close the seam 334.

With continued reference to FIG. 14, the sleeve 330 includes a generally radially-extending tab 386*a*, 386*b* on opposite sides of the seam 334. The tabs 386*a*, 386*b* include respective coaxial apertures 390 through which the pin 346 is received. Specifically, the pin 346 is inserted through the respective apertures 390 in the tabs 386*a*, 386*b*, such that the tabs 386*a*, 386*b* are sandwiched between the washer 370 and the fastener 382. Alternatively, the threaded end 350 of the pin 346 may be anchored in a blind bore in one of the tabs 386*a*, 386*b*.

With reference to FIG. 20, when the seam 334 is open, the handle portion 358 is generally oriented at an angle non-parallel with the longitudinal axis of the pin 346 to yield a first distance D1 between the pivot axis 368 and the cam surfaces 374, along the line of contact 378, to allow the washer 370 to move closer to the axle 366. When the seam 334 is open, the clamping force applied by the base 314 to the housing 318 is reduced so that the housing 318 is movable relative to the base 314 along the central axis 332.

To close the seam 334, the handle portion 358 is pivoted with respect to the pin 346 in a counterclockwise direction about the pivot axis 368, from the point of view of FIG. 20, to move or displace the washer 370 away from the pivot axis 368. As shown in FIG. 19, the spacing between the pivot axis 368 and the cam surfaces 374, along the line of contact 378, is increased to a second distance D2 that is greater than the first distance D1. Because the threaded end 350 of the pin 346 is anchored to the tab 386*b* by the fastener 382, this increase in distance from D1 to D2 is taken up by the seam 334, forcing the tab 386*a* closer to the tab 386*b* and closing the seam 334. When the seam 334 is closed, the increased clamping force on the housing 318 fixes the housing 318 in a position relative to the base 314.

Figure 22:
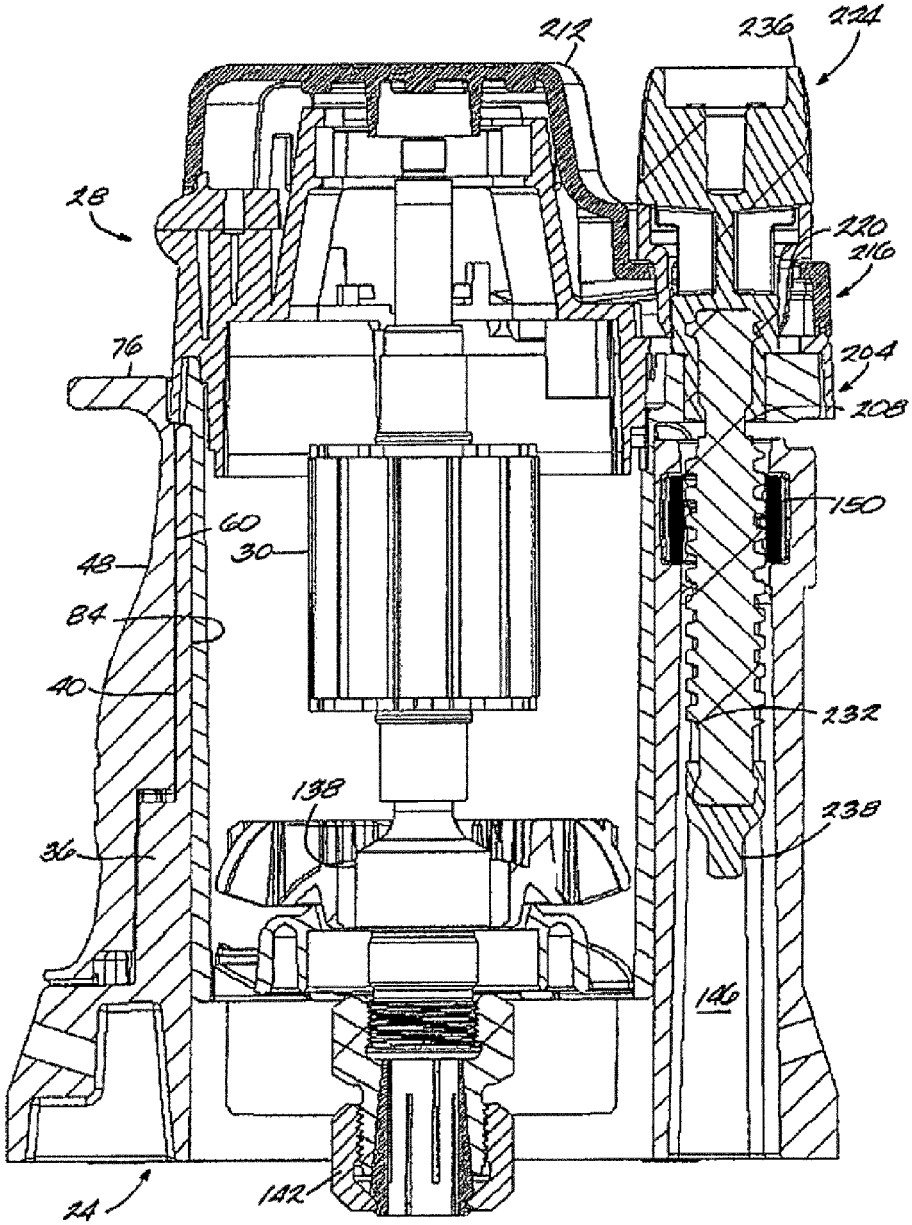
FIG. 22 is a front perspective view of the router of FIG. 13, illustrating a motor housing of the router being coarsely adjusted to the second cutting depth setting.
Figure 15:
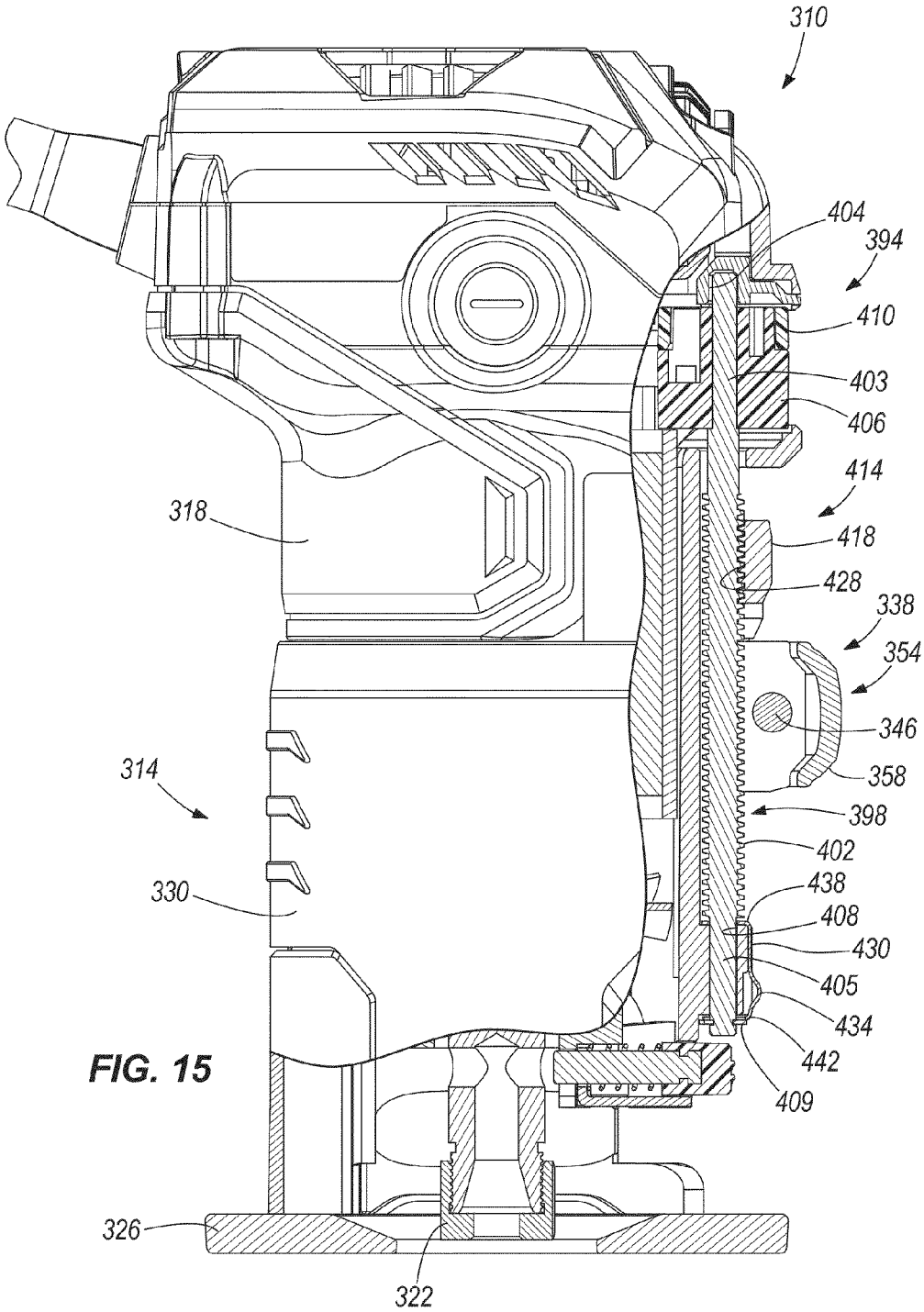
FIG. 15 is a cross-sectional view of the router of FIG. 13 taken along line 15-15 in FIG. 13, illustrating the router adjusted to a first cutting depth setting.
Figure 16:
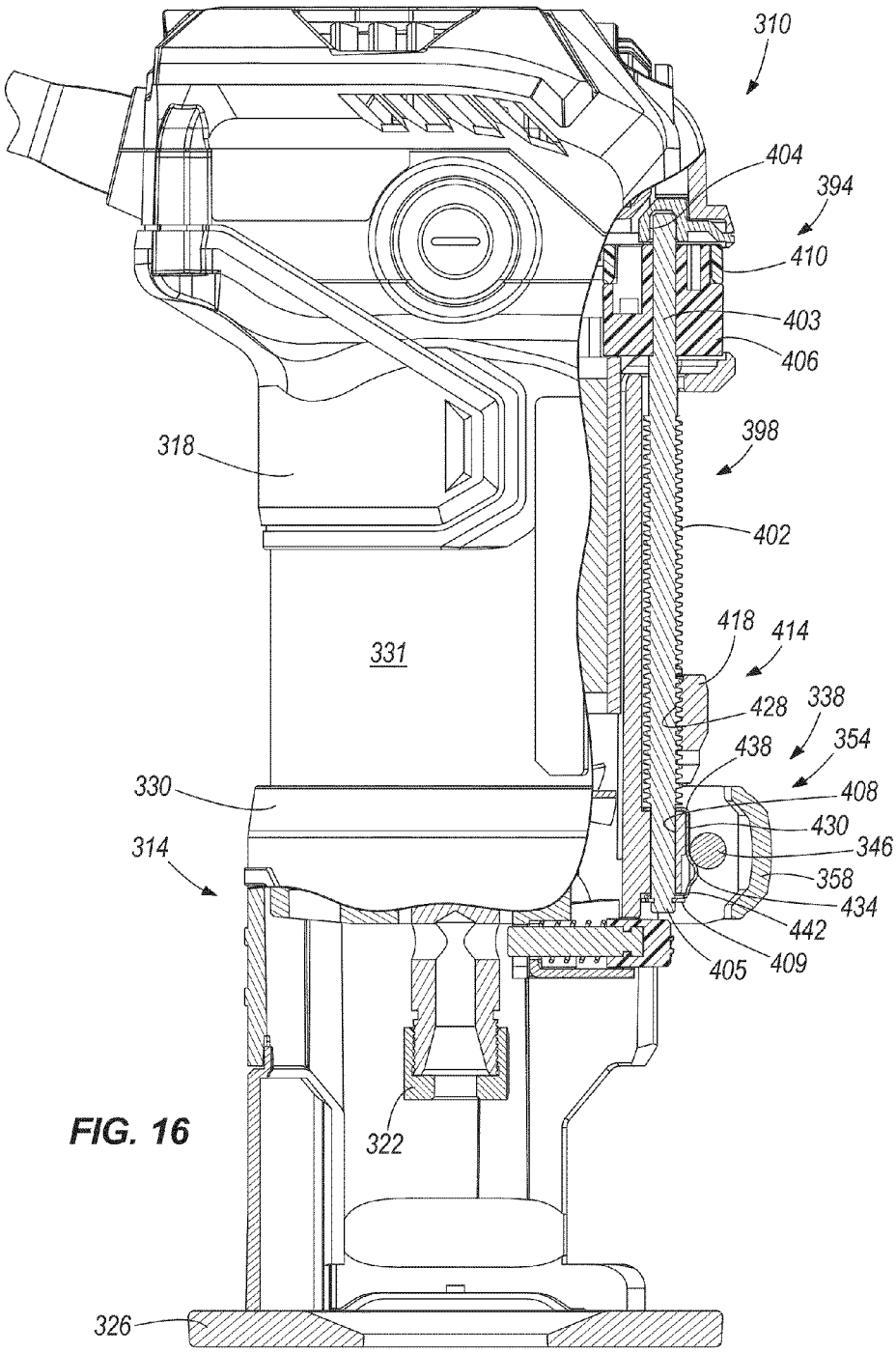
FIG. 16 is a cross-sectional view of the router of FIG. 15, illustrating the router adjusted to a second cutting depth setting.
Figure 21:
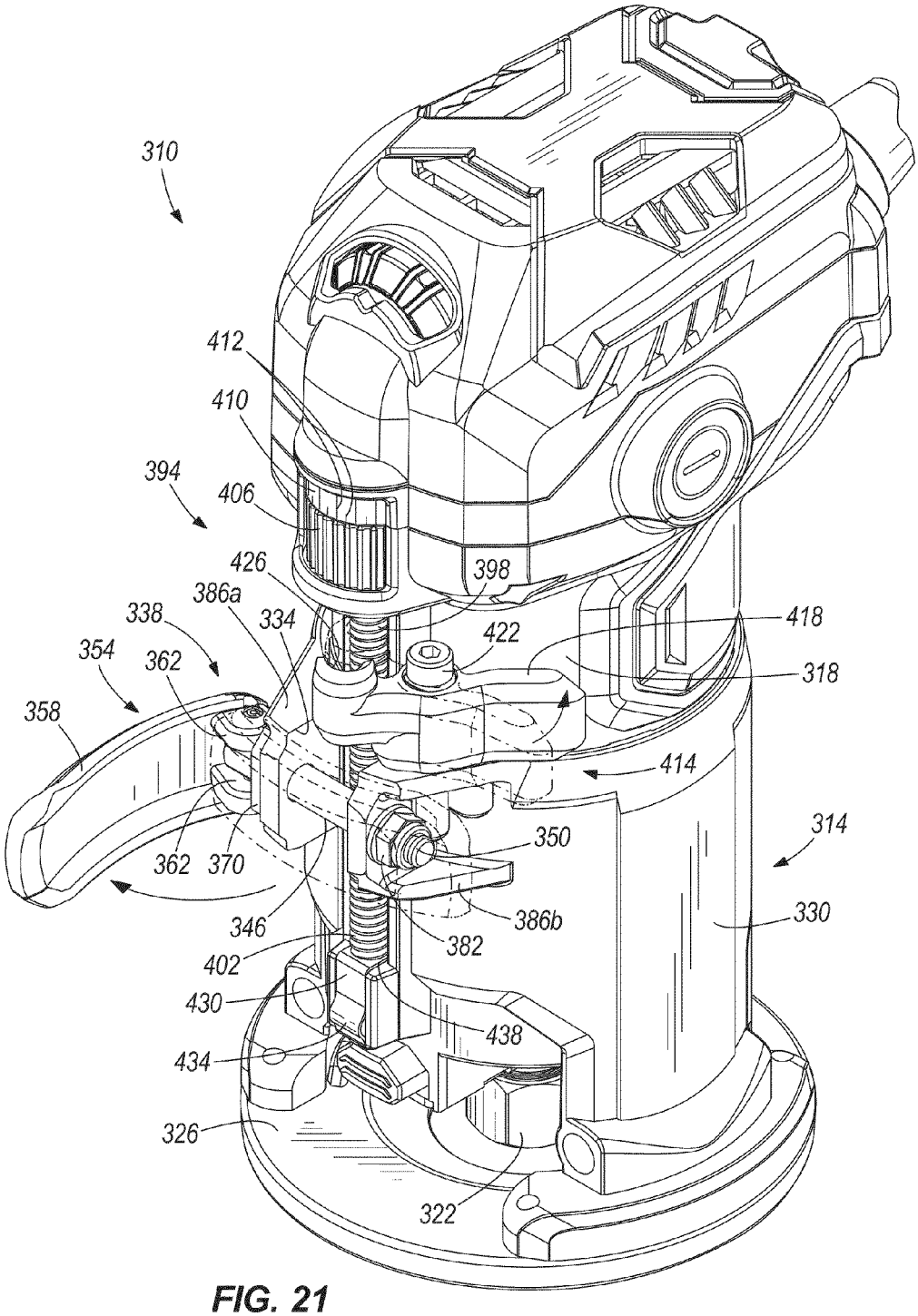
FIG. 21 is a front perspective view of the router of FIG. 13, illustrating the clamping mechanism in the release position and the depth adjustment mechanism in the disengaged position.
Figure 22:
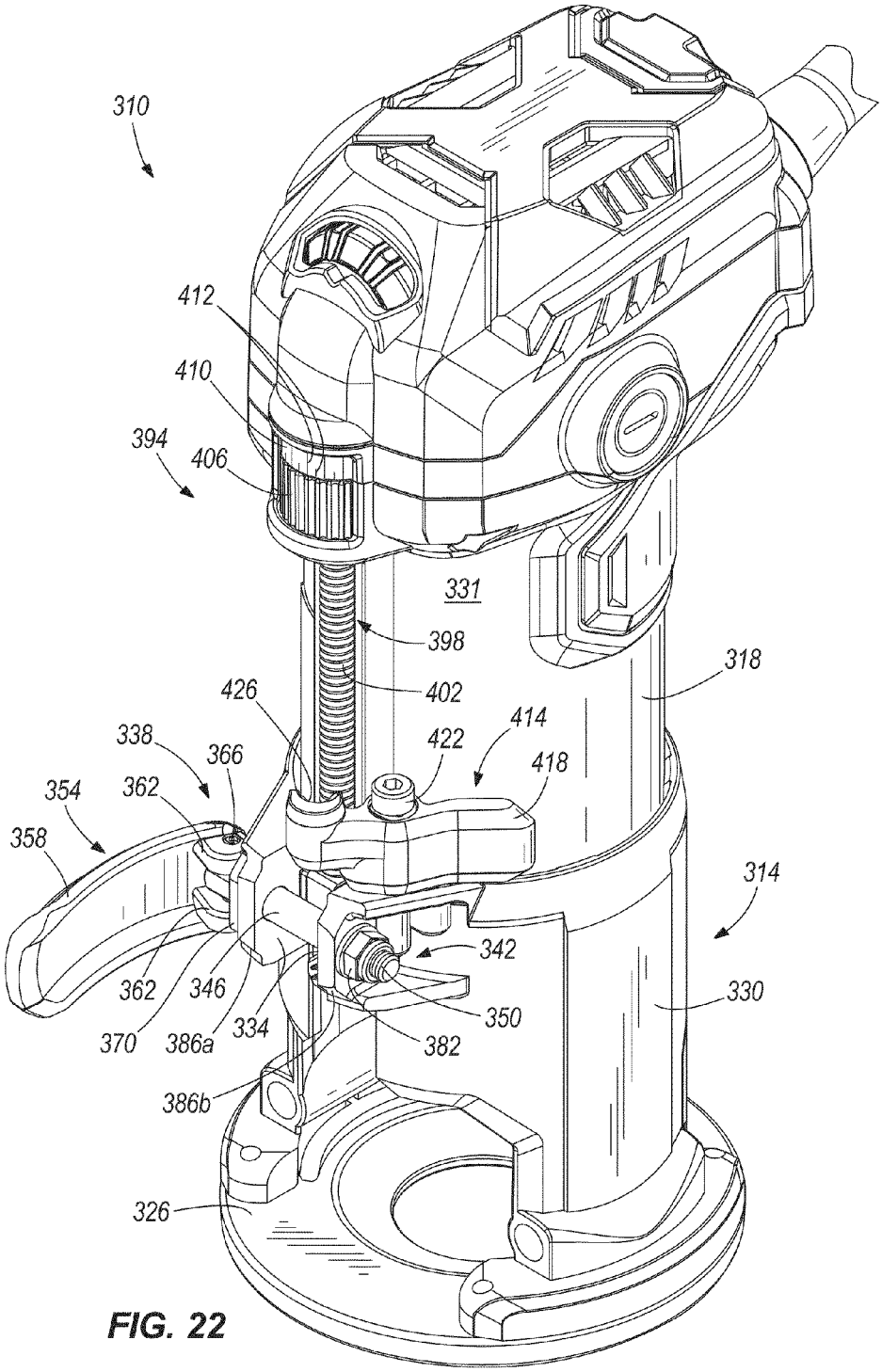

With reference to FIGS. 13 and 14, the router 310 also includes a depth adjustment mechanism 394 that cooperates with the housing 318 and the base 314 to control the vertical position of the housing 318 relative to the base 314, thereby controlling the depth of cut of the tool element. The depth adjustment mechanism 394 includes a depth adjustment shaft 398 supported for rotation about and translation along an axis 400 (FIG. 14) oriented substantially parallel with the central axis 332 of the motor housing 318. The shaft 398 also includes a threaded portion 402 and is supported for rotation by at least one of the motor housing 318 and the base 314. In the illustrated construction of the router 310, opposite ends of the shaft 398 are supported by the motor housing 318, such that the shaft 398 translates relative to the base 314 with the motor housing 318 during adjustment of the tool element cutting depth (FIGS. 21 and 22). Specifically, an upper end 403 of the shaft 398 is received within a blind bore 404 in the motor housing 318, and a lower end 405 of the shaft 398 is received within an aperture 408 formed in the motor housing 318 coaxial with the blind bore 404 (FIGS. 15 and 16). A C-clip 409 is attached to the lower end 405 of the shaft 398 to limit the upward movement of the shaft 398 (i.e., from the point of view of FIG. 15). Alternatively, the shaft 398 may be supported for rotation by the base 314 and received within a threaded aperture (e.g., an internally-threaded sleeve insert) extending through the sleeve 330.

With reference to FIGS. 13-16, the depth adjustment mechanism 394 also includes an adjustment dial 406 attached to the upper end 403 of the depth adjustment shaft 398. In the illustrated construction of the router 310, the shaft 398 is press-fit or interference-fit to the dial 406, such that the shaft 398 and the dial 406 co-rotate when the dial 406 is rotated. Alternatively, the dial 406 and the shaft 398 may be integrally formed as a single piece.

The depth adjustment mechanism 394 also includes a zero reset dial or zero position indication ring 410 coaxially mounted to the adjustment dial 406. The zero position indication ring 410 is rotatable relative to the housing 318, and is selectively rotatable relative to the adjustment dial 406 about the adjustment shaft axis 400. The ring 410 is imprinted or otherwise marked with position-indicating markings 412 (e.g., decimal or metric increments) to facilitate cutting depth adjustment measurement when the dial 406 is rotated with respect to the ring 410. The zero position indication ring 410 has substantially the same outer diameter of the dial 406 and is positioned above the adjustment dial 406. Alternatively, the zero position indication ring 410 may have a different outer diameter than the dial 406, or the ring 410 may be positioned below the adjustment dial 406.

With reference to FIGS. 13 and 14, the depth adjustment mechanism 394 also includes a unitarily formed lock mechanism 414 pivotably coupled to the sleeve 330 about an axis 416 oriented substantially parallel with the axis 400 of rotation of the shaft 398 and the central axis 332 of the motor housing 318. The lock mechanism 414 is configured as a lever 418 pivotably coupled to the sleeve 330 by a fastener 422 (e.g., a cap screw or shoulder screw see FIG. 14). Specifically, the lever 418 includes an aperture 424 sized to provide a radial clearance for the shank of the fastener 422 to allow the lever 418 to be freely pivoted about the fastener 422 (and the axis 416). The sleeve 330 includes a threaded, blind bore 425 within which the fastener 422 is secured to cantilever the lever 418 from the sleeve 330. Alternatively, the lever 418 may be pivotably coupled to the sleeve 330 in any of a number of different ways.

The lever 418 also includes a groove 426 in which the threaded portion 402 of the shaft 398 is received. Thread-engaging members configured as mating threads 428 (FIG. 23) are formed in the groove 426 and selectively engage the threaded portion 402 at least about 90 degrees around the shaft 398. In the illustrated construction of the router 310, the threads 428 selectively engage the threaded portion 402 at least about 180 degrees around the shaft 398. With reference to FIG. 14, the depth adjustment mechanism 394 also includes a torsion spring 429 coupled between the sleeve 330 and the lever 418 to bias the lever 418 to a position in which the threads 428 in the groove 426 engage the threaded portion 402 of the shaft 398.

Figure 17:
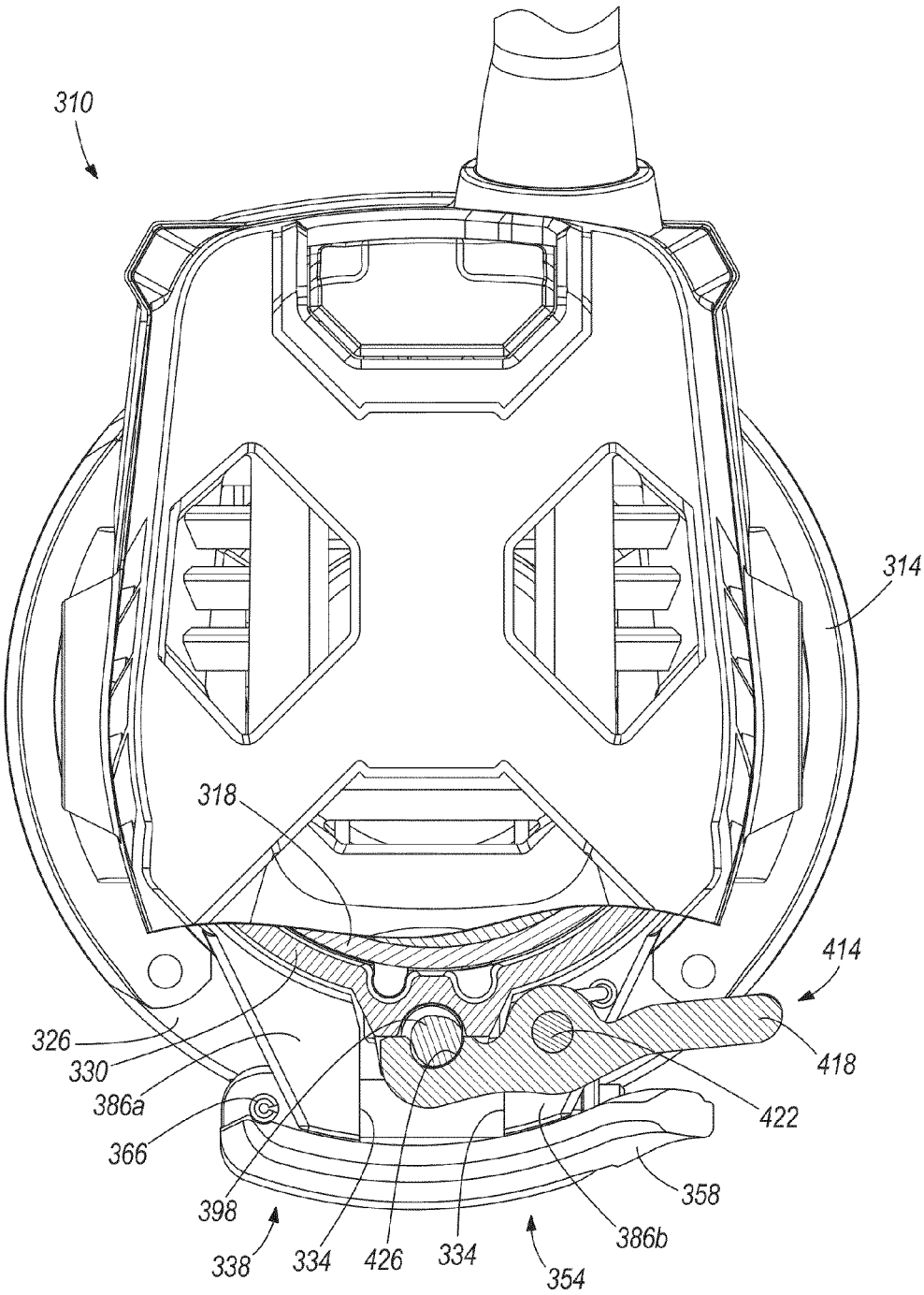
FIG. 17 is a cross-sectional view of the router of FIG. 13 taken along line 17-17 in FIG. 13, illustrating the depth adjustment mechanism in an engaged position.
Figure 18:
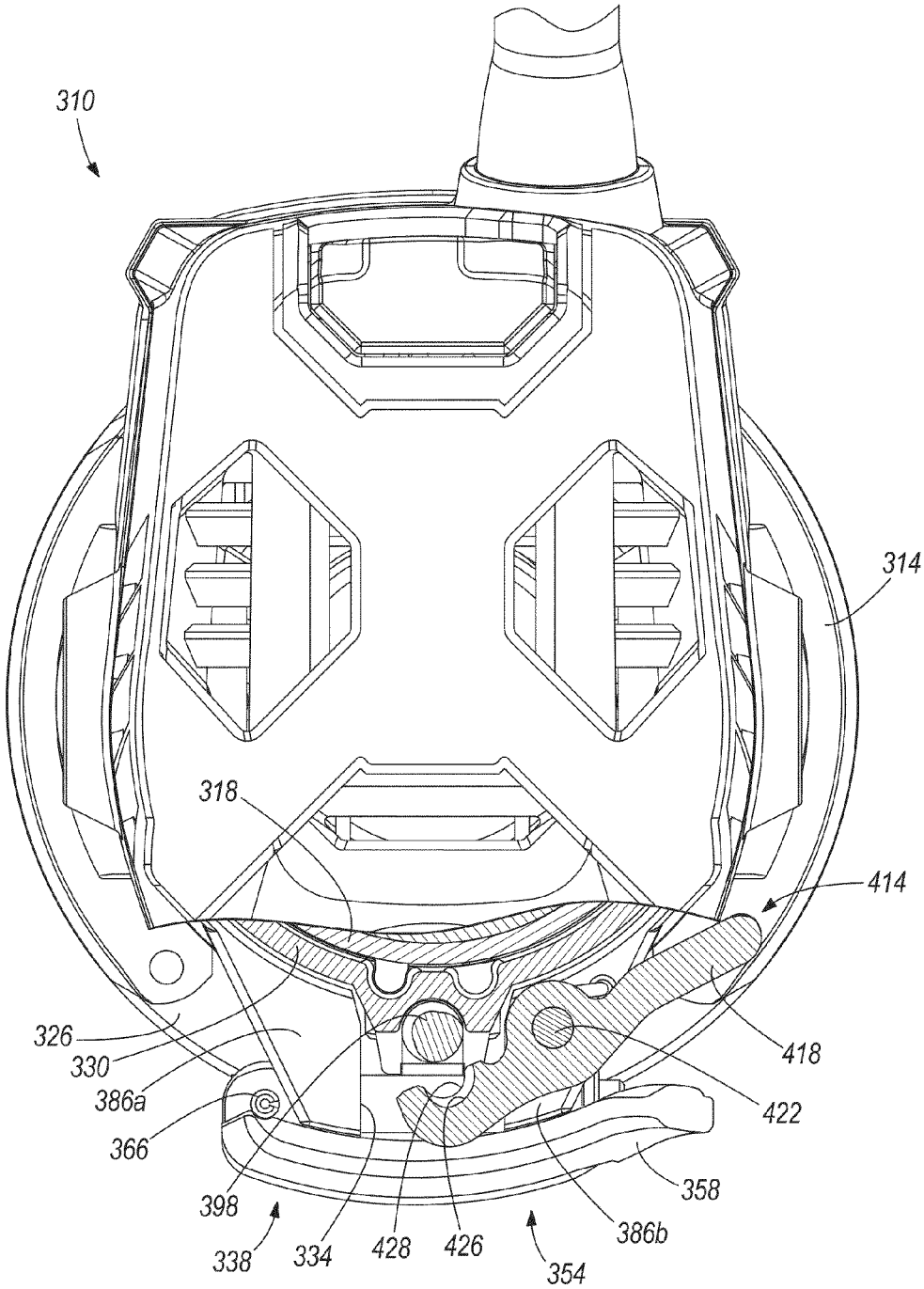
FIG. 18 is a cross-sectional view of the router of FIG. 17, illustrating the depth adjustment mechanism in a disengaged position.

Specifically, the lever 418 is movable between a thread-engaging position (FIG. 17), in which the threads 428 in the groove 426 engage the threaded portion 402 of the shaft 398, and a disengaged position (FIG. 18), in which the threads 428 in the groove 426 do not engage the threaded portion 402 of the shaft 398. The lever 418 is biased to the orientation shown in FIG. 17 by the torsion spring 429. To move the lever 418 to its disengaged position, an operator of the router 310 need only depress the end of the lever 418 opposite the end with the groove 426, as shown in FIG. 21. To move the lever 418 to its thread-engaging position, the operator need only to release the lever 418 to allow the torsion spring 429 to pivot the lever 418 back to the thread-engaging position shown in FIG. 17.

With reference to FIGS. 13-16, the depth adjustment mechanism 394 also includes a catch 430 configured to prevent unintentional removal of the motor housing 318 from the base 314 during adjustment of the position of the motor housing 318 relative to the base 314. The catch 430 is configured as a thin, C-shaped, resilient member having a raised portion 434 on a long side of the catch 430 (FIGS. 15 and 16). The catch 430 also includes upper and lower tabs 438, 442 having respective apertures through which the lower end 405 of the shaft 398 is received. The C-clip 409 on the lower end 405 of the shaft 398 is positioned beneath the lower tab 442 of the catch 430.

Figure 23:
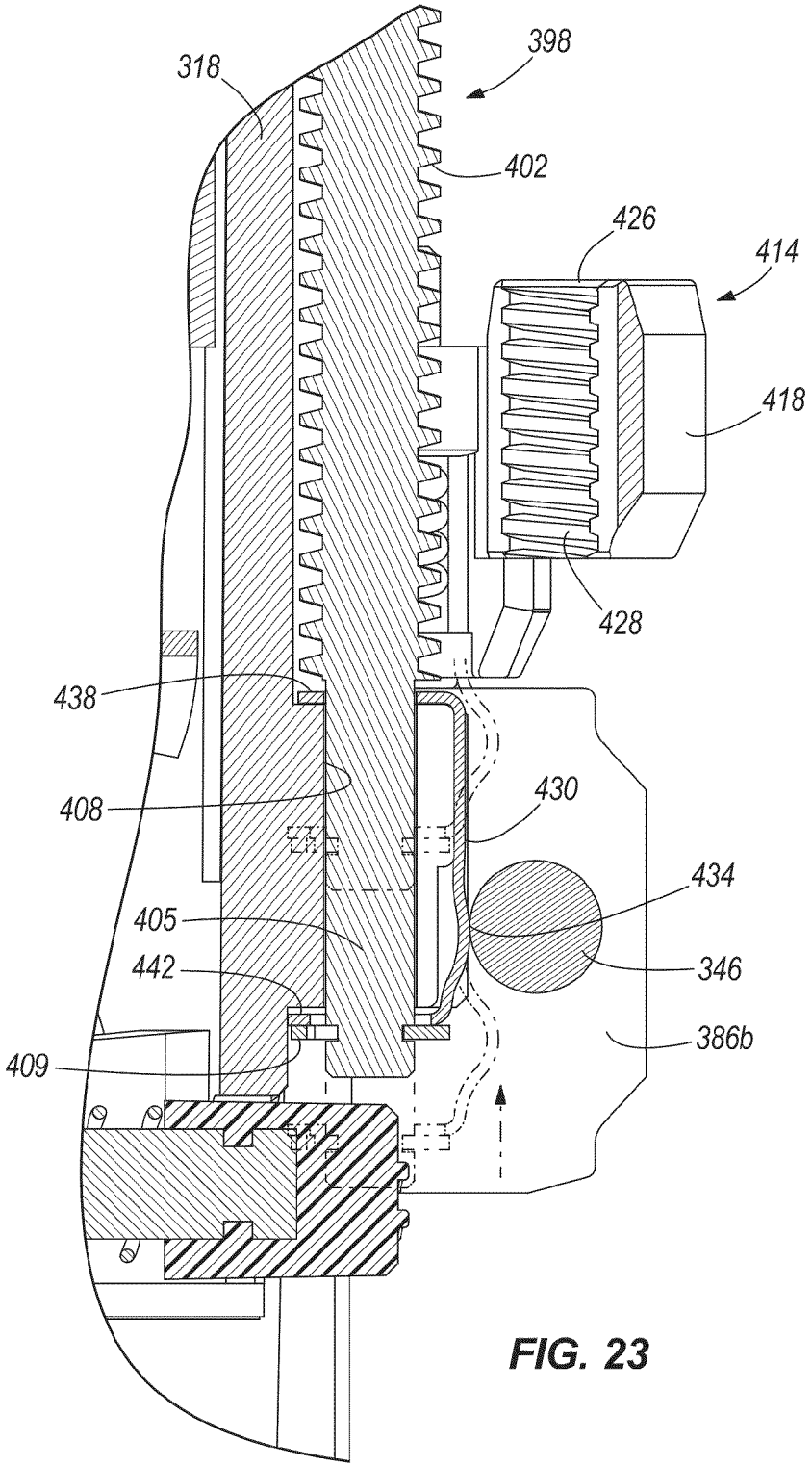
FIG. 23 is an enlarged, cross-sectional view of the router of FIG. 13 illustrating removal of the motor housing from a base of the router.

As shown in FIG. 16, the raised portion 434 is engageable with the pin 346 to prevent unintentional removal of the motor housing 318 from the base 314. However, intentional removal of the motor housing 318 from the base 314 may be accomplished by the operator of the router 310 providing an outward force on the motor housing 318, from its position shown in FIG. 16, sufficient to cause the raised portion 434 to be depressed and pass beneath the pin 346 (FIG. 23). After the raised portion 434 has passed beneath the pin 346, the catch 430 resumes its undeflected shape and the motor housing 318 may be completely removed from the base 314.

The depth adjustment mechanism 394 may be used to adjust the vertical position of the housing 318 relative to the base 314 in two modes, after the clamping mechanism 338 is released. For coarse adjustment, the lever 418 is pivoted away from the threaded portion 402 of the shaft 398, against the bias of the torsion spring 429, thereby releasing the threaded portion 402 of the shaft 398 from engagement with the lever 418 (FIGS. 21 and 22). The housing 318 is then free to move or translate along its central axis 332 relative to the base 314. After the desired vertical position of the housing 318 is achieved, the lever 418 is released and the torsion spring 429 again biases the lever 418 to its thread-engaging position to engage the threads 428 in the groove 426 with the threaded portion 402 of the shaft 398. After the lever 418 is re-engaged with the depth adjustment shaft 398, the housing 318 is restricted from free translational movement or coarse adjustment relative to the base 314 because the lever 418 is axially fixed to the base 314 by the fastener 422.

For fine adjustment, the lever 418 remains engaged with the depth adjustment shaft 398. The adjustment dial 406 is rotated, thereby rotating the depth adjustment shaft 398 and the threaded portion 402. The threaded portion 402 rotates relative to the threads 428 in the groove 426 of the stationary lever 418, causing the housing 318 to move in relatively small increments in a vertical direction relative to the base 314. For example, the threaded portion 402 of the shaft 398 may include a pitch of 1/16th of an inch, such that one complete revolution of the dial 406 provides vertical adjustment of the housing 318 relative to the base 314, and subsequently cutting depth adjustment of the tool element, of about 1/16th of an inch. Alternatively, the threaded portion 402 of the shaft 398 may be configured with a different pitch to provide more or less vertical adjustment for each revolution of the dial 406.

The zero position indication ring 410 may also be used to measure the amount of vertical adjustment of the motor housing 318 relative to the base 314 during fine adjustment using the depth adjustment mechanism 394. For example, the tip of the tool element may be positioned flush with the lower surface of the base plate 326, or the upper surface of a workpiece, to first determine a "zero" position. Then, the zero position indication ring 410 is rotated while the dial 406 is held stationary to align the "zero" marking on the indication ring 410 with a corresponding alignment marking on the motor housing 318. The dial 406 and indication ring 410 may then be co-rotated in a clockwise direction (looking down at the top of the router 310) the desired amount of adjustment according to the markings on the indication ring 410. Friction between the dial 406 and the indication ring 410 allows the operator to grasp only the dial 406 when performing fine adjustment of the cutting depth of the tool element. Further, for an operator to decrease the cutting depth of the tool element, the indication ring 410 may be rotated while the dial 406 is held stationary to align the marking on the indication ring 410 corresponding with the desired amount of adjustment with the corresponding alignment marking on the motor housing 318. Then, the dial 406 and indication ring 410 may be co-rotated in a counter-clockwise direction (looking down at the top of the router 310) until the "zero" marking on the indication ring 410 is in alignment with the corresponding alignment marking on the motor housing 318.

In operation, an operator often needs to adjust the cutting depth of the router 310. To adjust the router 310 from a first cutting depth to a second cutting depth, the operator first releases the clamping mechanism 338, as described above. This action releases the sleeve 330 from clamping engagement with the housing 318. Coarse adjustment of the position of the housing 318 relative to the base 314 is preferably performed first as described above. Fine adjustment of the position of the housing 318 relative to the base 314 is then performed. Once the desired vertical position is achieved, the operator clamps the clamping mechanism 338 to re-engage the sleeve 330 and the housing 318, thereby substantially restricting the housing 318 from further movement relative to the base 314. The operator may then operate the router 310 in a conventional manner. Additional depth adjustments may be made by repeating this process.

Various features of the invention are set forth in the following claims.

What is claimed is:

1. A router comprising:

a base for supporting the router on a work piece surface;

a motor housing supported by the base for movement along a first axis to a position relative to the base;

a motor supported by the housing and operable to drive a tool element; and an adjustment mechanism for adjusting the position of the housing relative to the base, the adjustment mechanism including a shaft connected to the motor housing for rotation about a second axis and having a thread portion, and a unitarily formed lock mechanism supported by the base, the lock mechanism including a thread-engaging member being selectively engageable with the thread portion, wherein, upon the thread-engaging member engaging the thread portion, the shaft is rotated to cause small changes to the position of the housing relative to the base, the lock mechanism being movable between an engaged position, in which the thread-engaging member engages the thread portion, and a disengaged position, in which the thread-engaging member disengages the thread portion and the housing is freely movable relative to the base to provide course adjustment of the position of the housing relative to the base.

2. The router of claim 1, wherein the adjustment mechanism includes a biasing member for biasing the lock mechanism toward the engaged position.

3. The router of claim 1, wherein the lock mechanism includes a groove, and wherein the thread-engaging member includes a plurality of threads extending outwardly from the groove.

4. The router of claim 3, wherein the groove extends at least about 90 degrees around the shaft.

5. The router of claim 3, wherein the groove extends at least about 180 degrees around the shaft.

6. The router of claim 3, wherein the lock mechanism includes a lever engageable by an operator to move the lock mechanism between the engaged position and the disengaged position.

7. The router of claim 6, wherein the lever is pivotable, between the engaged position and the disengaged position, relative to the base about a pivot axis oriented substantially parallel with the first and second axes.

8. The router of claim 7, wherein the groove extends in a direction substantially parallel with the pivot axis, and wherein the groove is spaced from the pivot axis.

9. The router of claim 1, wherein the adjustment mechanism further includes an adjustment dial coupled to an upper end of the shaft and rotatable with the shaft relative to the housing to allow an operator to manually rotate the shaft.

10. The router of claim 9, wherein the adjustment mechanism further includes a position indication ring disposed adjacent the dial, wherein the position indication ring includes a plurality of markings corresponding with depth adjustment positions.

11. The router of claim 1, wherein the motor housing is removable from the base.

12. The router of claim 1, further comprising a clamping mechanism including a clamping member operable to apply a clamping force to the housing to fix the housing in a position relative to the base, and an actuator for moving the clamping member between a clamping position, in which the clamping member applies the clamping force to the housing, and a release position, in which the clamping force is at least reduced such that the housing is movable relative to the base.

13. The router of claim 12, wherein the base includes a seam oriented in a direction substantially parallel with the first and second axes, and wherein the clamping member is operable to apply the clamping force to the housing to at least partially close the seam.

14. The router of claim 13, wherein the clamping member is configured as a pin oriented in a direction substantially perpendicular to the seam, and wherein the actuator is pivotably coupled to the pin and pivotable relative to the pin between the clamping position and the release position.

15. The router of claim 14, wherein one end of the pin is secured to the housing on one side of the seam, and wherein the actuator is pivotably coupled to the pin at a location disposed on an opposite side of the seam.

16. The router of claim 14, wherein the actuator includes at least one cam member having a cam surface engageable with the housing, wherein the actuator is pivotable about a pivot axis between the clamping position and the release position, and wherein the spacing between the cam surface and the pivot axis, along a line intersecting the pivot axis and a point of tangency between the cam surface and the housing, is greater when the clamping member is in the clamping position than when the clamping member is in the release position.

17. The router of claim 16, wherein the actuator includes a handle portion oriented substantially transversely to the pivot axis.

18. The router of claim 14, wherein the adjustment mechanism further includes an adjustment dial coupled to an upper end of the shaft, and a catch disposed proximate a lower end of the shaft, wherein the catch is engageable with the pin to provide an upper limit to the adjustment of the position of the motor housing relative to the base.

19. The router of claim 18, wherein the catch is made from a resilient material, wherein the catch includes a raised portion engageable with the pin when the motor housing is positioned in the upper limit relative to the base, and wherein the raised portion is deflectable to allow the catch to move past the pin to facilitate removal of the motor housing from the base.

20. The router of claim 1, wherein the lock mechanism is cantilevered from the base.

* * * * *